US007822501B2

(12) United States Patent
Tashiro

(10) Patent No.: US 7,822,501 B2
(45) Date of Patent: Oct. 26, 2010

(54) EMBROIDERY DATA CREATION APPARATUS AND COMPUTER READABLE RECORDING MEDIUM INCLUDING EMBROIDERY DATA CREATION COMPUTER PROGRAM

(75) Inventor: Noriharu Tashiro, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 766 days.

(21) Appl. No.: 11/879,512

(22) Filed: Jul. 18, 2007

(65) Prior Publication Data

US 2008/0017090 A1 Jan. 24, 2008

(30) Foreign Application Priority Data

Jul. 19, 2006 (JP) ..... 2006-197306

(51) Int. Cl.
*D05C 5/02* (2006.01)

(52) U.S. Cl. ..... 700/138; 112/102.5

(58) Field of Classification Search ..... 700/140, 700/131, 133, 136–138; 112/102.5, 475.18, 112/475.01, 475.04, 475.05
See application file for complete search history.

(56) References Cited

U.S. PATENT DOCUMENTS 4,982,674 A * 1/1991 Hayakawa ..... 700/138
4,991,524 A * 2/1991 Ozaki ..... 700/138
5,927,220 A 7/1999 Zheng et al.
6,247,420 B1 * 6/2001 Chan et al. ..... 700/138
7,359,760 B2 * 4/2008 Kishi et al. ..... 700/138
7,542,822 B2 * 6/2009 Kawaguchi et al. ..... 700/138

FOREIGN PATENT DOCUMENTS

| | | |
|---|---|---|
| JP | A-58-198378 | 11/1983 |
| JP | A-63-125284 | 5/1988 |
| JP | A-2-307957 | 12/1990 |
| JP | A-3-75085 | 3/1991 |
| JP | A-3-123587 | 5/1991 |
| JP | A-4-24053 | 1/1992 |
| JP | A-4-261699 | 9/1992 |
| JP | A-5-92090 | 4/1993 |
| JP | A-6-343779 | 12/1994 |
| JP | A-10-146477 | 6/1998 |
| JP | A-2002-102561 | 4/2002 |

* cited by examiner

*Primary Examiner*—Danny Worrell
(74) *Attorney, Agent, or Firm*—Oliff & Berridge, PLC

(57) ABSTRACT

An embroidery data creation apparatus for adjusting the density of needle drop points, and a computer readable recording medium having an embroidery data creation program recorded therein which includes instructions for adjusting the density of needle drop points. The embroidery data creation apparatus may include a device for judging whether a needle drop point is a turning point, a device for determining a reference point, a device for determining whether a turning point is within a predetermined area from the reference point, and a device for changing a coordinate of the turning point, deleting the turning point, or maintaining of a coordinate of the turning point.

16 Claims, 20 Drawing Sheets

FIG. 5

122

| ADJUSTMENT ARRAY STORAGE AREA | | | | | | | | | | | |
|---|---|---|---|---|---|---|---|---|---|---|---|
| ARRAY NUMBER (k) | 1 | 2 | 3 | 4 | 5 | 6 | ····· | 14 | 15 | 16 | ····· |
| MARK LEVEL | 0 | 0 | 0 | 0 | 1 | 0 | ····· | 0 | 2 | 0 | ····· |

EMBROIDERY DATA CREATION APPARATUS AND COMPUTER READABLE RECORDING MEDIUM INCLUDING EMBROIDERY DATA CREATION COMPUTER PROGRAM

CROSS-REFERENCE TO RELATED APPLICATION

This application claims priority from JP2006-197306, filed Jul. 19, 2006, the entirety of which is hereby incorporated by reference.

BACKGROUND

The related technical fields include an embroidery data creation apparatus and a computer readable recording medium including an embroidery data creation program. More particularly, the related technical fields include an embroidery data creation apparatus for adjusting needle drop point density and a computer readable recording medium including an embroidery data creation computer program having instructions for adjusting needle drop point density.

SUMMARY

In the related art, when an attempt is made to sew up a predetermined area by means of an embroidery thread, one of the methods for embroidery sewing by means of an embroidery sewing machine includes sewing a gap between a set of opposite contours in a predetermined area at a stitch. In an example shown in a schematic view 900 shown in FIG. 19, a gap between opposite contours "ab" and "cd" is sewn at a stitch in order to sew up the inside of trapezoidal shape "abcd" by means of an embroidery thread. In such sewing, needle drop points on the contour "ab" and needle drop points on the contour "cd" become equal to each other in number. In a case where a start point and an end point exist on one contour, the number of needle drop points on that contour is larger by 1. Therefore, in a case where, for example, a difference in length between the contour "cd" and the contour "ab" of FIG. 19 is significant, if the number of turns between the contours is such that the density of the needle drop points becomes proper on a shorter contour, the density of the needle drop points on a longer contour becomes sparse, making it difficult to sew up the inside of the area, and degrades the appearance of the sewn up embroidery pattern, lowering a sewing quality.

In addition, conversely, if the number of turns is such that the density of the needle drop points on the longer contour becomes proper, the needle drop points become dense on the shorter contour. As a result, the embroidery thread tends to bunch up on the shorter contour, and degrades the appearance of the sewn up embroidery pattern, lowering a sewing quality. In particular, as in a schematic view 950 shown in FIG. 20, the problem described above has been significant in the case where one contour is very short or in the case where one contour is a dot.

Therefore, according to a needle drop data creation apparatus for the embroidery sewing machine described in Japanese Patent Application Laid-open KOKAI No. 4-261699, the number of turns according to a difference in length between a set of contours is determined, and then, a needle drop point to be displaced on a shorter contour is disposed at a middle drop point in a sewing-up area, not on the contour. This middle drop point is set so that the thread density in an area becomes substantially uniform.

However, the needle drop data creation apparatus for embroidery sewing machine described in Japanese Patent Application Laid-open KOKAI No. 4-261699 experiences a problem because a computing process for calculating a middle drop point is complicated. In addition, a position of a needle drop point, i.e., a stitch route depends on a shape of an area to be sewn up. Therefore, there is a problem that a position of the middle drop point depends on the shape of the area, and non-uniformity occurs with correction of thread density by the shape of area.

It is one object of the present disclosure to solve the foregoing problem. It is another object of the present disclosure to provide an embroidery data creation apparatus for adjusting the density of needle drop points and a computer readable recording medium including an embroidery data creation computer program having instructions for adjusting the density of needle drop points.

In a first aspect of this disclosure, there is provided an embroidery coordinate storage device that stores a coordinate of a needle drop point serving as a start point or an end point of an embroidery stitch; a turning point judgment device that judges whether the needle drop point of the coordinate stored in the embroidery coordinate storage device is a turning point whose angle is smaller than a predetermined quantity, where the angle is defined by a preceding stitch of which the needle drop point serves as an end point and a succeeding stitch of which the needle drop point serves as a start point; a reference point determination device that determines at least one reference point from a needle drop point; an area determination device that determines a predetermined area around a needle drop point that is determined to be a reference point, where the predetermined area is based on at least one of thread density of the embroidery sewing, thread thickness, and a pitch length of a stitch; an area internal turning point judgment device that judges whether a turning point is in the predetermined area; an adjustment process selection device that selects, in a case where it is judged that a turning point is in the predetermined area, any one of the following adjustment processes: a process for maintaining a coordinate of the turning point, a process for changing a coordinate of the turning point, and a process for deleting the turning point, wherein the adjustment process is selected based on a coordinate position relationship between the turning point and another needle drop point having a coordinate that is stored in the embroidery coordinate storage device; and an adjustment control device that calculates a new coordinate of a turning point for a turning point that the process for changing the coordinate is selected, where the new coordinate is calculated based on a coordinate of the turning point and coordinates of at least two needle drop points adjacent to the turning point, and deletes a turning point for a turning point that a process for deleting is selected.

In a second aspect of the present disclosure, there is provided a computer readable recording medium including an embroidery data creation computer program comprising: turning point judgment instructions for judging whether a needle drop point, which serves as a start point or an end point of an embroidery stitch, is a turning point whose angle is smaller than a predetermined quantity, where the angle is defined by a preceding stitch of which the needle drop point serves as an end point and a succeeding stitch of which the needle drop point serves as a start point; reference point determination instructions for determining at least one reference point from a needle drop point judged to be a turning point; area determination instructions for determining a predetermined area around a needle drop point that is determined to be a reference point, where the predetermined area is based on at least one of thread density of the embroidery sewing, thread thickness, and a pitch length of a stitch; area internal turning point judgment instructions for judging whether a turning point is in the predetermined area; adjustment process selection instructions for selecting, in a case where it is judged that a turning point is in the predetermined area, any one of the following adjustment processes: a process for maintaining a coordinate of the turning point, a process for changing a coordinate of the turning point, and a process for deleting the turning point, wherein the adjustment process is selected based on a coordinate positional relationship between the turning point and another needle drop point; and adjustment control instructions for calculating a new coordinate of a turning point for a turning point that the process for changing the coordinate is selected, where the new coordinate is calculated based on a coordinate of the turning point and coordinates of at least two needle drop points adjacent to the turning point, and deleting a turning point for a turning point that the process for deleting is selected.

BRIEF DESCRIPTION OF THE DRAWINGS

Exemplary embodiments of the disclosure will be described below in detail with reference to the accompanying drawings in which:

FIG. 5 is a schematic view depicting a configuration of an adjustment array storage area;

DETAILED DESCRIPTION OF EMBODIMENTS

Exemplary embodiments of the broad principles described herein are described. Referring now to the accompanying drawings, an embroidery data creation apparatus 1 according to one embodiment of the present disclosure may create embroidery data for outputting a pattern expressed by image data by means of embroidery sewing using an embroidery sewing machine 3, based on the image data. First, the embroidery sewing machine 3 will be described.

Figure 1:
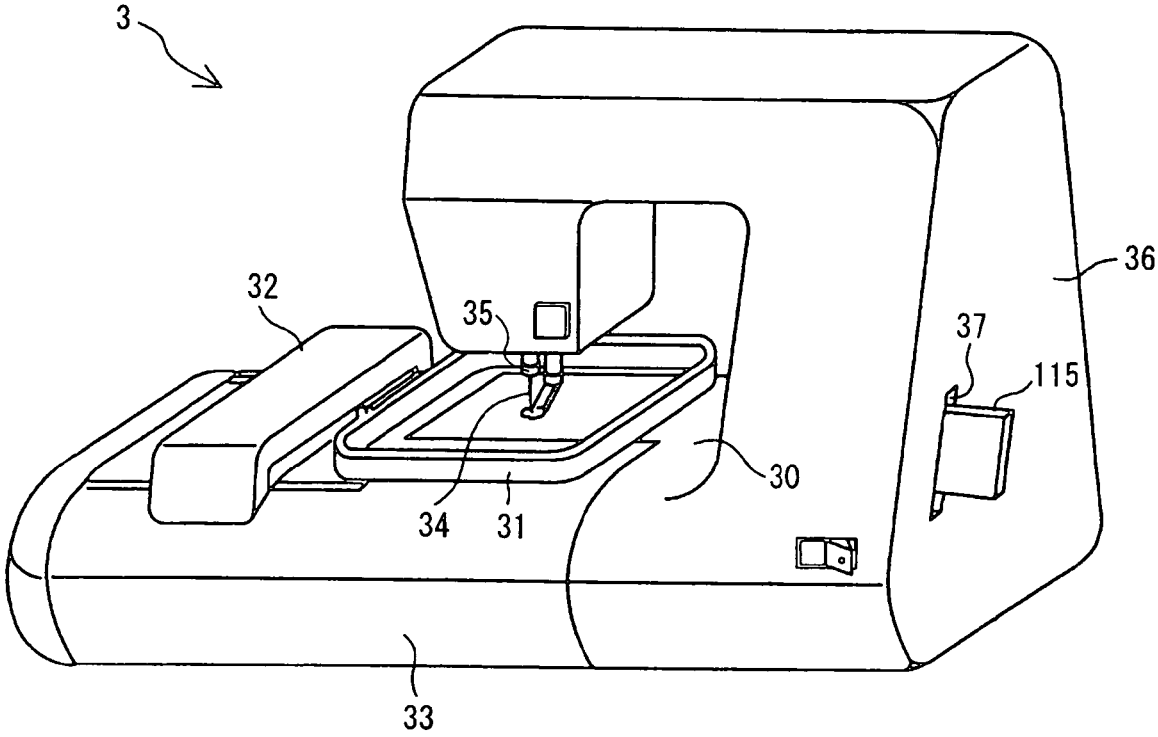
FIG. 1 is an external view of an embroidery sewing machine.

As shown in FIG. 1, the embroidery sewing machine 3 may be equipped with: a needle bar mechanism (not shown) for vertically driving a needle bar 35 for attaching a sewing needle 34; a thread take-up mechanism (not shown); and a shuttle mechanism (not shown). In addition, the embroidery sewing machine 3 may be equipped with: a Y-direction drive mechanism (not shown) which, housed in a carriage cover 32 transferring to a longitudinal direction of the embroidery sewing machine 3 (longitudinal direction of paper) an embroidery frame 31 for retaining a work cloth (not shown) for applying embroidery sewing, disposed on a sewing machine bed 30; and an X-direction drive mechanism (not shown) housed in a main body case 33 transferring the Y-direction drive mechanism in a transverse direction of the embroidery sewing machine 3 (transverse direction of paper). While the embroidery frame 31 may be moved by means of these Y-direction drive mechanism and X-direction drive mechanism, a sewing operation may be made under the cooperation of the needle bar mechanism, the thread take-up mechanism, and the shuttle mechanism, thereby applying embroidery sewing of a predetermined pattern to that work cloth. A sewing machine motor (not shown) for driving the needle bar mechanism, thread take-up mechanism, and shuttle mechanism and respective motors (not shown) for driving the Y-direction drive mechanism and X-direction drive mechanism may be controlled to be driven by means of a control device composed of microcomputers or the like incorporated in the embroidery sewing machine 3. In addition, a memory card slot 37 may be mounted on a side face of a pillar 36 of the embroidery sewing machine 3. A memory card 115 having embroidery data stored therein may be mounted on the memory card slot 37, whereby the embroidery data created by means of the embroidery data creation device 1 may be supplied. In addition, this embroidery sewing machine 3 and the embroidery data creation apparatus 1 may be configured so that they can be interconnected via a cable, whereby the embroidery data may be directly supplied without interposing a storage medium such as a memory card.

The embroidery data creation apparatus 1 will be described with reference to FIGS. 2-5.

Figure 2:
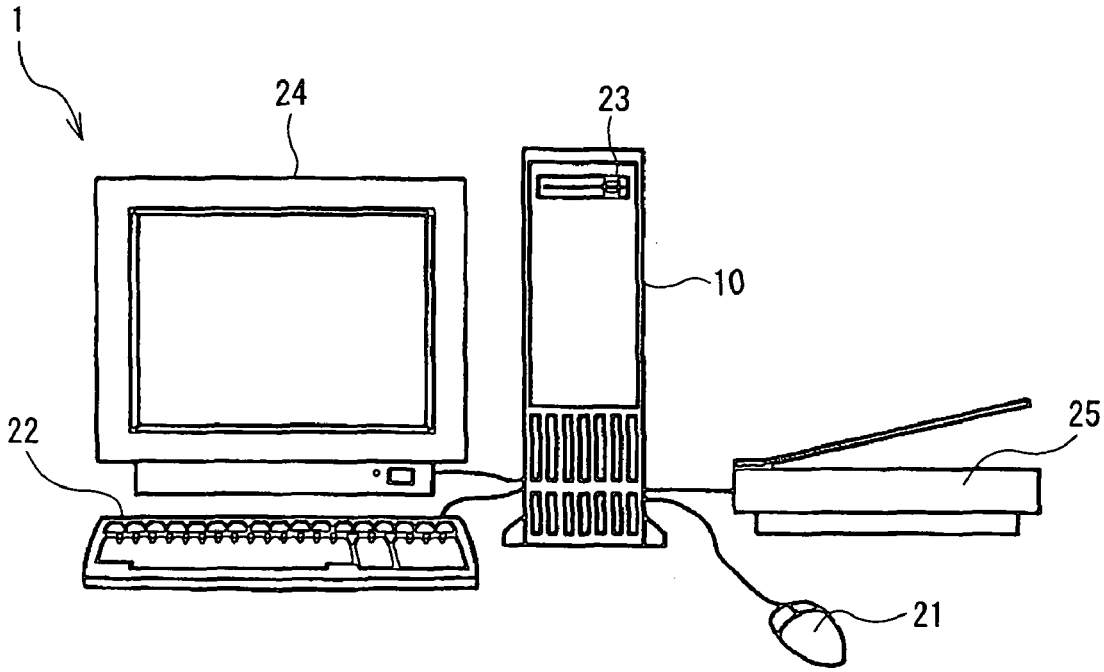
FIG. 2 is an entire schematic view depicting a physical configuration of an embroidery data creation apparatus.

As shown in FIG. 2, embroidery data creation device 1 may include: an equipment main body 10 serving as a so called personal computer; a mouse 21 connected to this equipment main body 10; a keyboard 22; a memory card connector 23; a display 24; and an image scanner unit 25. The shapes of the equipment main body 10, the mouse 21, the keyboard 22, the memory card connector 23, the display 24, and the image scanner unit 25 are not limited to those shown in FIG. 2. For example, the equipment main body 10 may be transversely placed without being limited to a tower type, and may be of notebook type such that the equipment main body 10, the display 24, and the keyboard 22 are integrated with each other. In addition, the equipment main body 10, of course, may be a dedicated machine, instead of a so-called personal computer.

Figure 3:
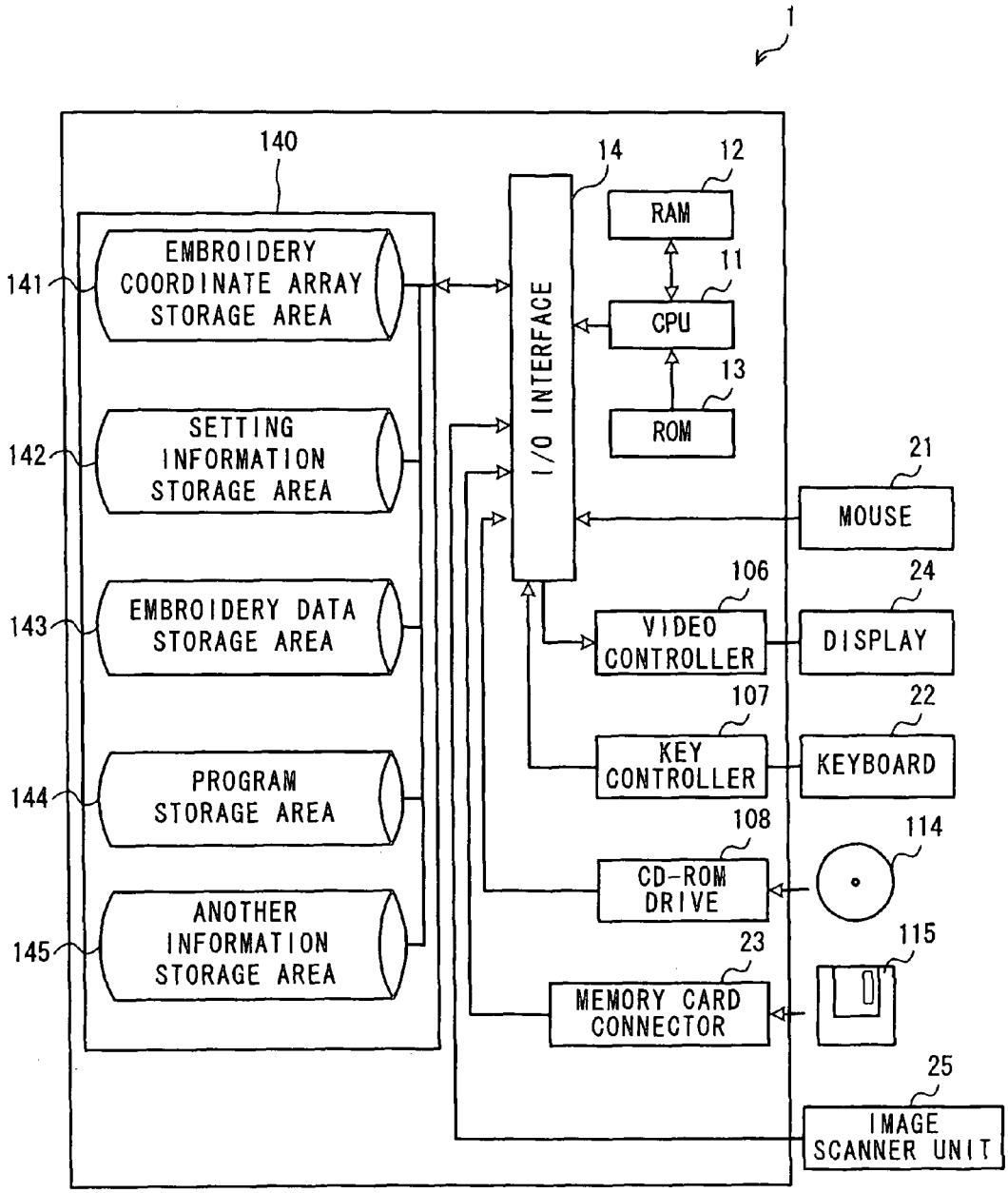
FIG. 3 is a block diagram schematically depicting an electrical configuration of an embroidery data creation apparatus.

Referring now to the block diagram of FIG. 3, an electrical configuration of the embroidery data creation apparatus 1 will be described. As shown in FIG. 3, a CPU 11 serving as a controller responsible for control of the embroidery data creation apparatus 1 may be provided in the embroidery data creation apparatus 1. To the CPU 11, there are connected: a RAM 12 that may temporarily store a variety of data; a ROM 13 which may store BIOS or the like therein; and an I/O interface 14 that serves as an interface for exchange of data. A hard disk unit 140 may be connected to the I/O interface 14. In the hard disk unit 140, there may include an embroidery coordinate array storage area 141; a setting information storage area 142; an embroidery data storage area 143; a program storage area 144; and another information storage area 145.

The embroidery coordinate array storage area 141 stores coordinates of needle drop points for creating embroidery data in one-dimensional arrays. Hereinafter, by way of example, when a value stored in a fifth array of the one-dimensional arrays is indicated, it is referred to as "embroidery coordinate array (5)". In addition, the needle drop point denotes a point at which a sewing needle 34 penetrates a work cloth and an upper thread and a lower thread cross each other, whereby a stitch is formed. In this case, the coordinates of needle drop points may be stored in sequential order in which embroidery sewing is actually carried out. In other words, a coordinate of a start point of embroidery sewing may be stored in embroidery coordinate array (1), and a line segment connected by a coordinate stored in embroidery coordinate array (1) and that stored in embroidery coordinate array (2) is equivalent to a first stitch.

In addition, the setting information storage area 142 may store settings used for creating embroidery data such as thread density, thread thickness, or a pitch length of a stitch. Although these setting methods are not described in detail in particular, the embroidery data creation program may enable a user to make entries on a setting screen, although not shown, whereby the entries may be stored in the setting information storage area 142. Then, the embroidery data storage area 143 may store embroidery data created by means of the embroidery data creation program, and then, the embroidery data may be read by means of the embroidery sewing machine 3. Further, the program storage area 144 may store an embroidery data creation program executed by means of a CPU 11. Another information storage area 145 may store other items of information used in the embroidery data creation apparatus 1. In the case where the embroidery data creation apparatus 1 is a dedicated machine that is not equipped with a hard disk unit 140, a program may be stored in a ROM.

In addition, a mouse 21, a video controller 106, a key controller 107, a CD-ROM drive 108, a memory card connector 23, and an image scanner unit 25 may be connected to an I/O interface 14. A display 24 may be connected to the video controller 106, and a keyboard 22 may be connected to the key controller 107. A CD-ROM 114 to be inserted into the CD-ROM drive 108 may store an embroidery data creation program that may serve as a control program of the embroidery data creation apparatus 1. At the time of installation, this control program may be set up from the CD-ROM 114 to the hard disk unit 140, and then, the set up program may be stored in the program storage area 144. In addition, the memory card connector 23 may enable read or write operation of the memory card 115.

Figure 4:
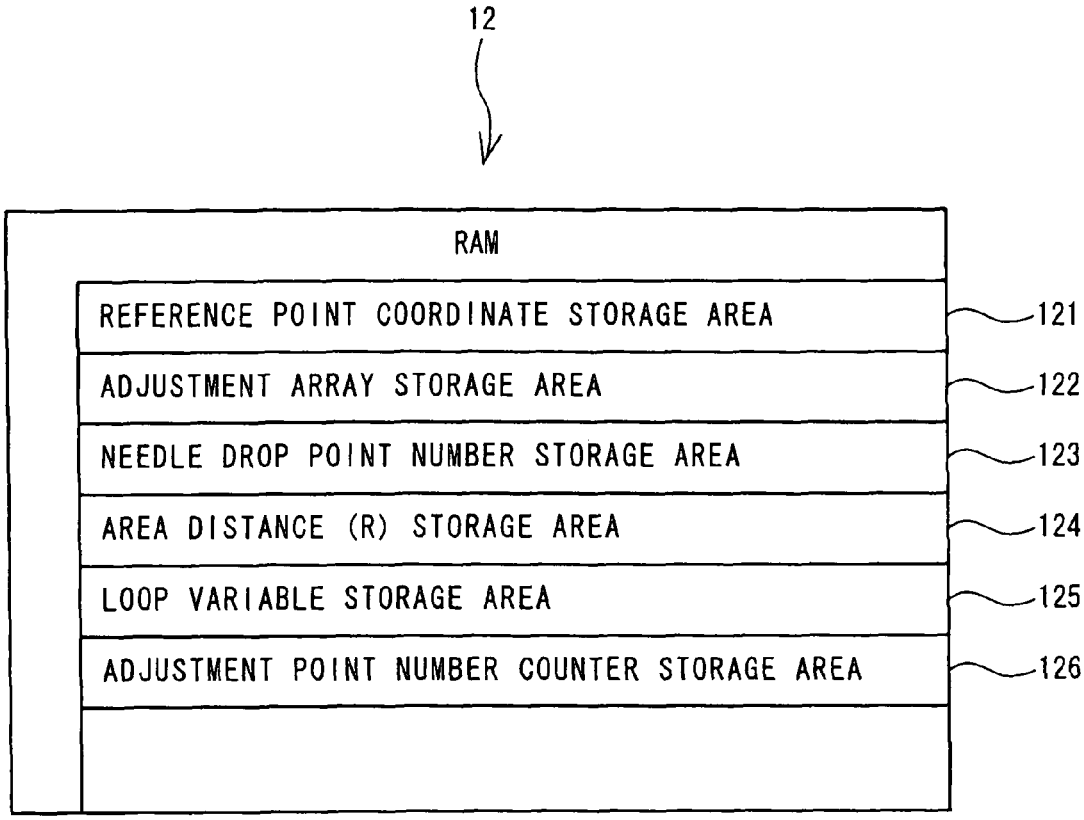
FIG. 4 is a schematic view depicting a configuration of a RAM.

Referring now to FIG. 4, a storage area provided in a RAM 12 will be described. In the RAM 12, there may include: a reference point coordinate storage area 121; an adjustment array storage area 122; a needle drop point number storage area 123; an area distance storage area 124; a loop variable storage area 125; and an adjustment point number counter storage area 126.

The reference point coordinate storage area 121 may store a coordinate of a needle drop point (hereinafter, referred to as a "reference point") that may serve as a reference for making adjustment of a needle drop point. In the case where reference points are present in plurality, the coordinates of all of the reference points may be stored. In addition, the adjustment array storage area 122 may be used to carry out marking for a needle drop point targeted for adjustment. This adjustment array storage area 122 will be described later with reference to FIG. 5. The needle drop point number storage area 123 may store the number of needle drop points stored in the embroidery coordinate array storage area 141. In other words, this stored number may serve as the array number of one-dimensional arrays in the embroidery coordinate array storage area 141 of the hard disk unit 140. Hereinafter, a value stored in this needle drop point number storage area 123 is referred to as "max".

In addition, the area distance storage area 124 may store a value relevant to a reference area for adjustment of a needle drop point. Specifically, this area may serve as an area in a circle of radius R from a reference point, and the area distance storage area 124 may store a value of radius R. The loop variable storage area 125 may serve as a storage area for a variety of variables used in an embroidery data creation program that carries out a process for adjustment of a needle drop point. The adjustment point number counter storage area 126 may serve as a storage area for storing an adjustment point number counter used to count the number of needle drop points adjusted in a process for adjustment of a needle drop point.

Referring now to FIG. 5, a description will be given with respect to the adjustment array storage area 122. The adjustment array storage area 122 may be provided as a one-dimensional array of number equal to the number of coordinates stored in the embroidery coordinate array storage area 141, in other words, the number of all needle drop points. With respect to respective needle drop points, information as to whether these needle drop points are targeted for study as to whether to make adjustment may be stored as a "mark level". An initial value "0" may be stored in all arrays, and, in the case where study of adjustment is made, a value "1" or more may be stored. Namely, in the case where a study of adjustment is not made, "0" may be stored. Specifically, "1" may be stored relative to a needle drop point targeted for study at a stage before a first adjustment process is carried out; "2" may be stored relative to a needle drop point newly targeted for study in a first time adjustment process; and "3" may be stored relative to a needle drop point newly targeted for study in a second time adjustment process. In other words, the stored values increase as the number of shots of adjustment process increases. A storage area relative to a third needle drop point of this adjustment array may be indicated as "adjustment array (3)". Namely, as the number of adjustment processes increases, the stored value, namely, a mark level increases.

Referring now to FIG. 6 to FIG. 12, a process for adjustment of a needle drop point will be described. In FIG. 6 to FIG. 12, the solid line indicates a stitch, and an end circle of the stitch indicates a needle drop point.

Figure 6:
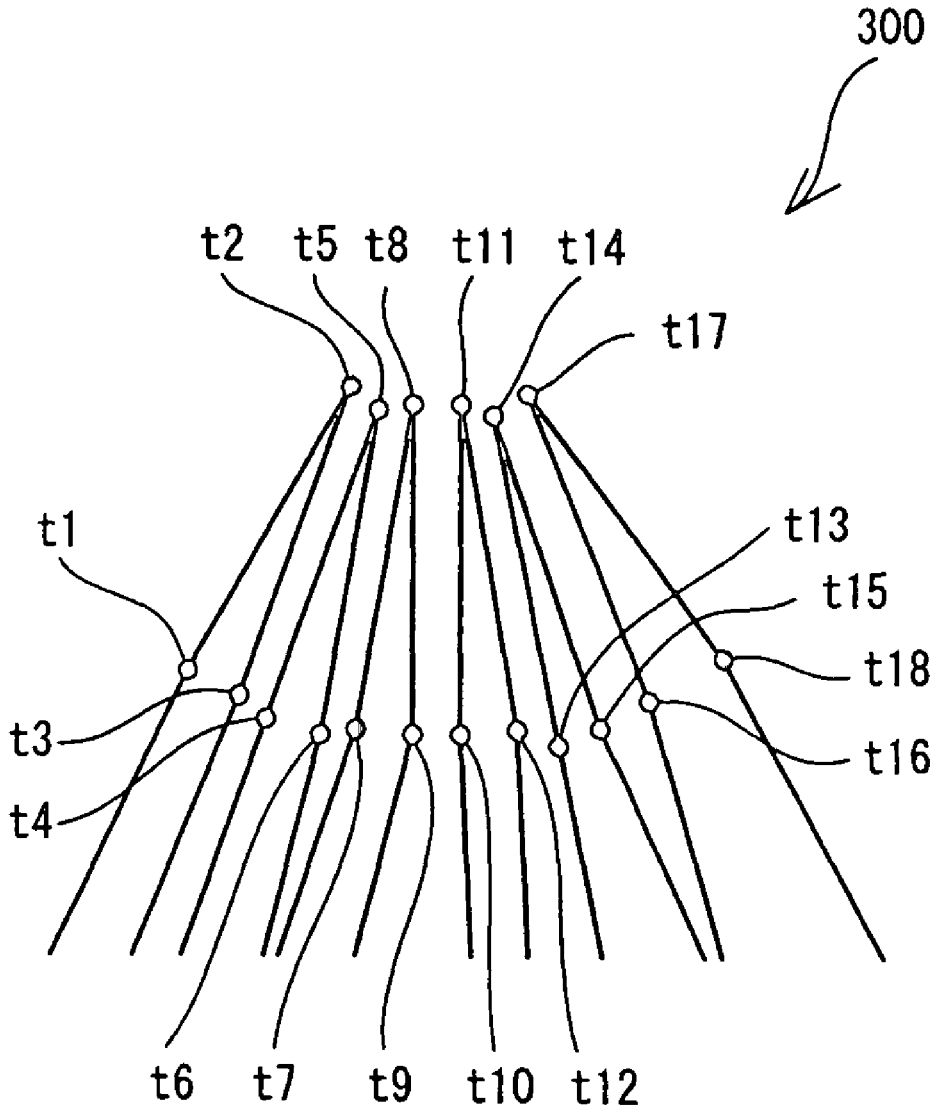
FIG. 6 is a schematic view depicting a needle drop point and a stitch before adjusted.
Figure 7:
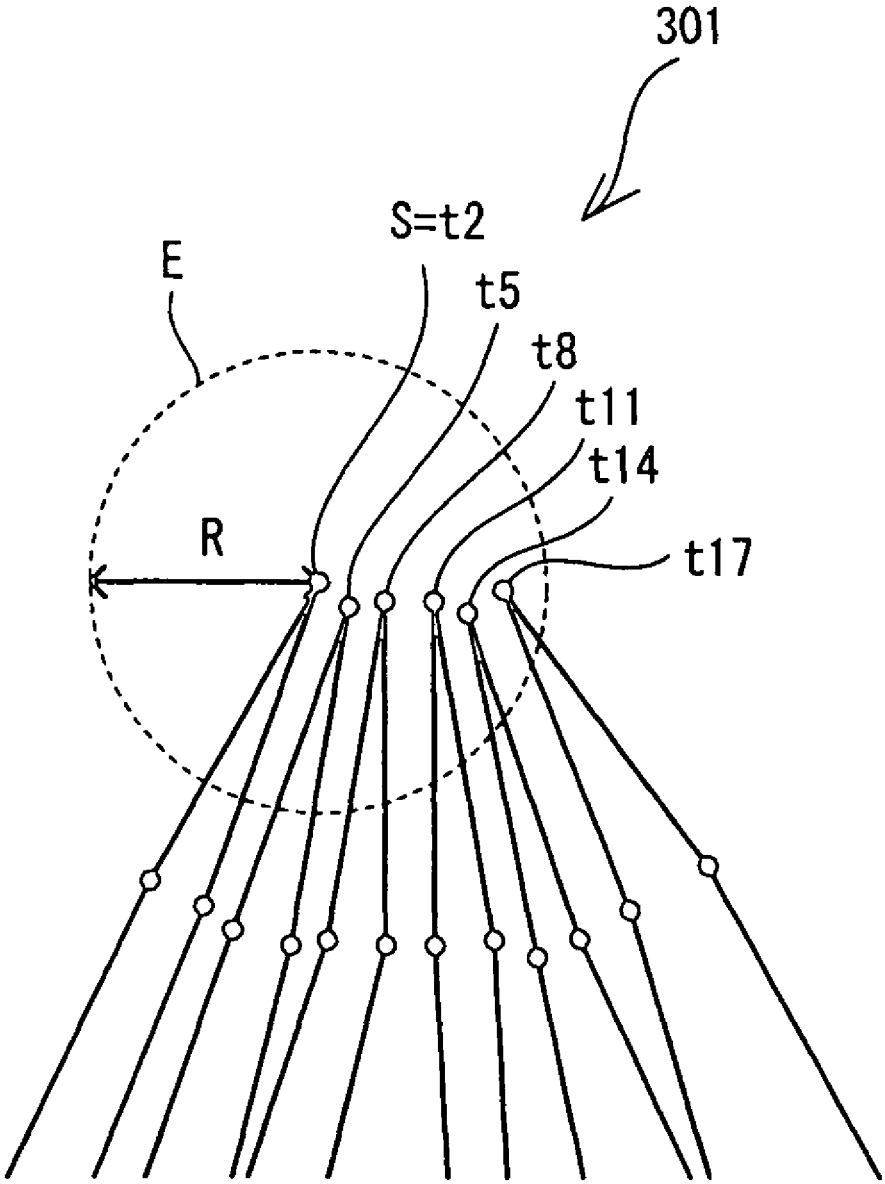
FIG. 7 is a schematic view depicting an area for determining a needle drop point targeted for adjustment.

In the embroidery coordinate array shown in FIG. 6, including the needle drop points t2, t5, t8, t11, t14, t17, the needle drop points of which angle formed by the preceding and succeeding stitches is narrower than a predetermined angle, namely, the needle drop points at which stitch turns, are referred to as "turning points". In addition, one reference point may be determined from among these needle drop points. In the present example, as shown in FIG. 7, a turning point t2 is defined as a reference point S. In addition, a circle of radius R around the reference point S serves as an area E for determining a needle drop point targeted for adjustment. The turning points that exist in this area E, such as t5, t8, t11, t14, t17, are defined as "area internal turning points" targeted for adjustment. The radius R is defined as a determined value based on at least one of thread density of embroidery sewing, thread thickness, and a pitch length of a stitch, and is defined as "2×10/thread density" in the present embodiment. The thread density is defined as the number of threads per 1 mm; 1 to 7 threads/mm can be set in the present embodiment; and the set value may be stored in a setting information storage area 142 of a hard disk unit 140.

Figure 8:
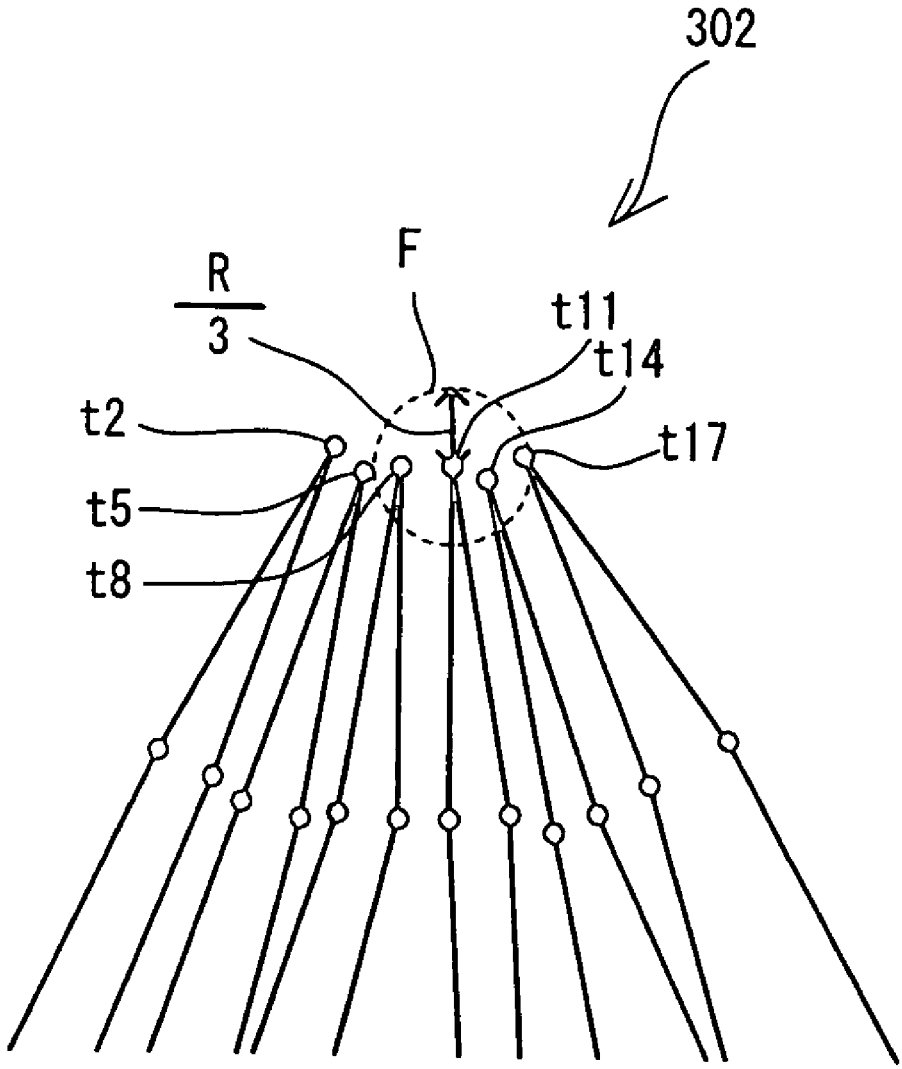
FIG. 8 is a schematic view depicting an area for judging whether to adjust a turning point.

Referring now to FIG. 8, the determination of whether to make adjustment, by way of example, of the area internal turning point t11 will be described. Here, a circle of radius R/3 around the area internal turning point t11 on which a judgment for whether adjustment is to be made is defined as an area F. In the example shown in FIG. 8, the area internal turning points t8, t14, t17 exist in the area F, and are defined as turning points for making adjustment. On the other hand, in this example, if any other needle drop point does not exist in the area F, no adjustment is made for those area internal turning point.

Figure 9:
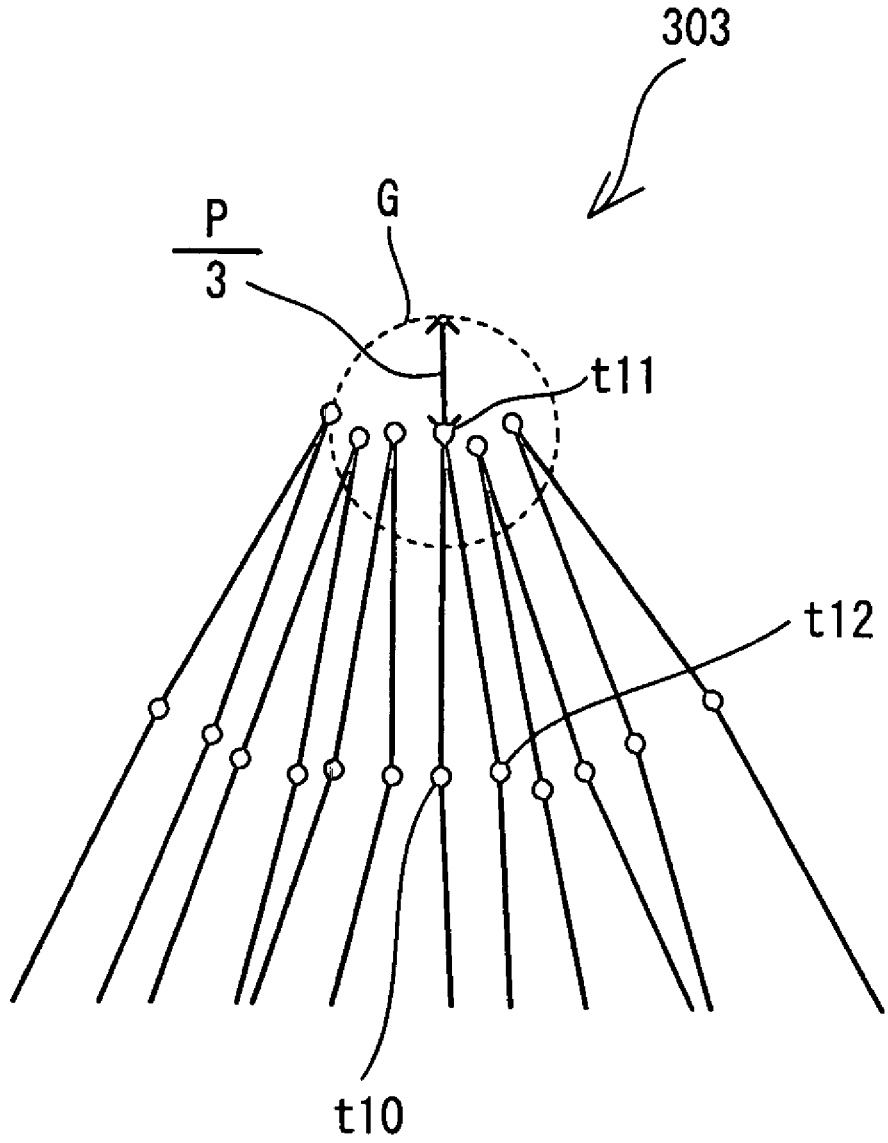
FIG. 9 is a schematic view depicting an area for judging how to adjust a turning point.

Referring now to FIG. 9, the determination of how to adjust the area internal turning point t11 judged that adjustment is made will be described. In the present embodiment, adjustment may be made by means of a process for moving the area internal turning point t11 (changing a coordinate) or a process for deleting the area internal turning point t11. As shown in FIG. 9, a circle of radius P/3 around the area internal turning point t11 at which judgment is to be made is defined as an area G for determining an adjustment process. P, which determines radius P/3, is defined as a value of a pitch length (basic length of a stitch) which may be stored in the setting information storage area 142, and may be preset by a user when embroidery data is created.

Figure 10:
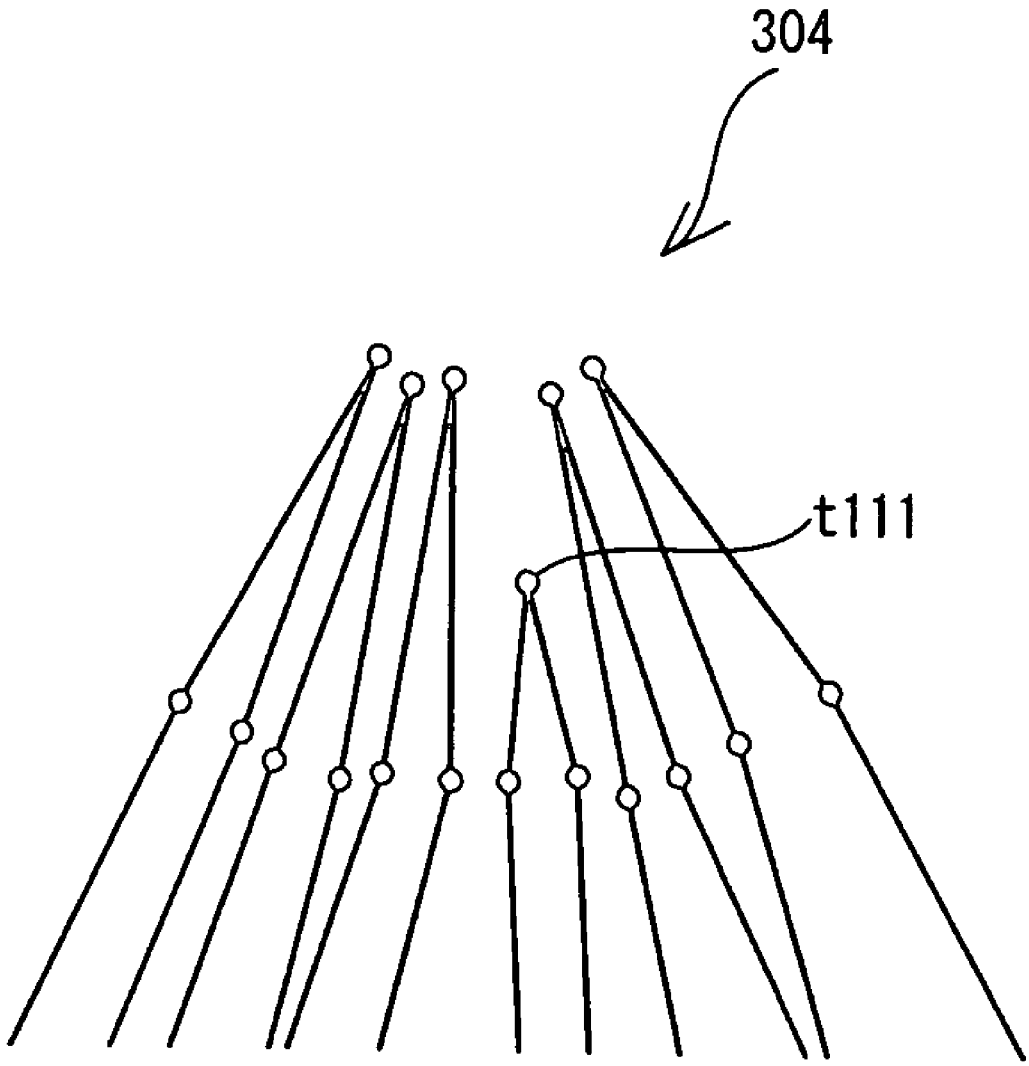
FIG. 10 is a schematic view depicting a state in which a turning point is moved to a movement destination point, and then, adjustment is made.

In this example, the needle drop points adjacent to the area internal turning points t11, in other words, a needle drop point t10 serving as a start point of a stitch of which the area internal turning point t11 is defined as an end point and a needle drop point t12 serving as an end point of a stitch of which the area internal turning point t11 is defined as a start point, are defined as the adjacent points t10, t12. Therefore, in the case where the adjacent point t10 does not exist in the area G, it is judged that the area internal turning point t11 should be moved. Then, as shown in FIG. 10, the area internal turning point t11 is moved to a position of a turning point t111. At this turning point t111, in a triangle made of three points of the area internal turning point t11 and the adjacent points t10, t12, a straight line may be drawn from the turning point t11 to a middle point of opposite edges t10 to t12 (middle line). The point t111 is defined as a point on this middle line, and, in the present embodiment, the point t111 is defined as a point at which the middle line is internally divided in half.

Figure 11:
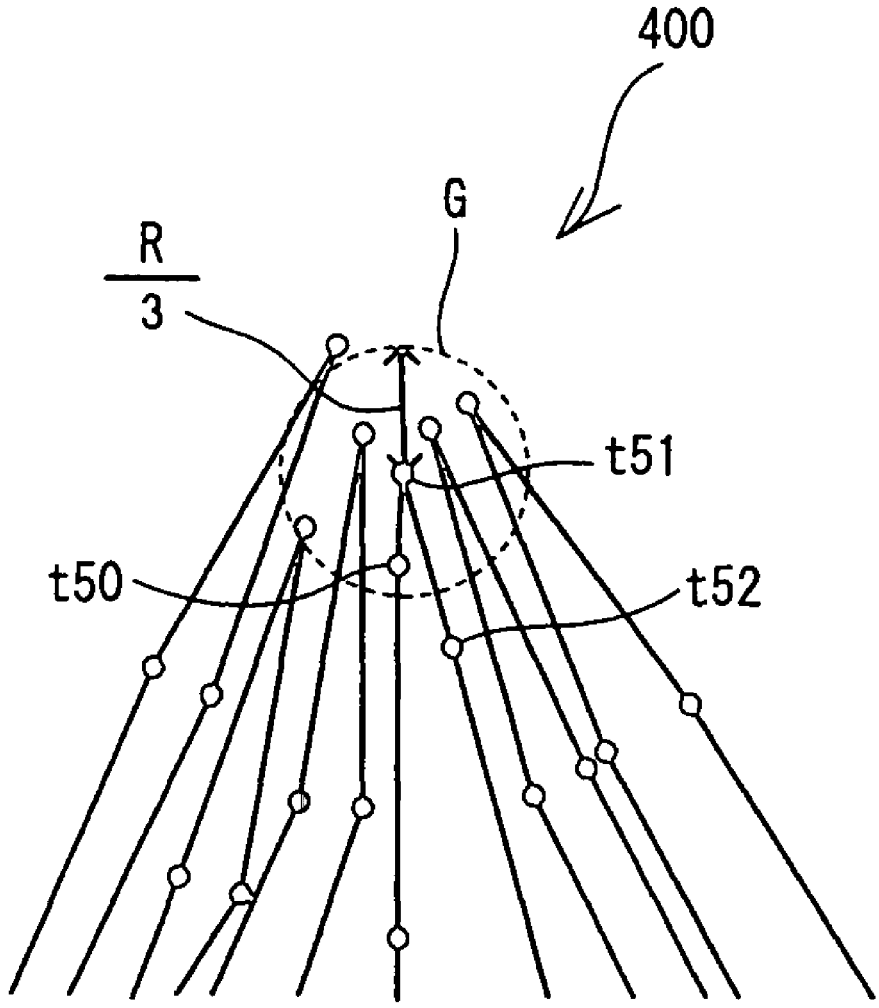
FIG. 11 is a schematic view depicting an area for judging how to adjust a turning point.
Figure 12:
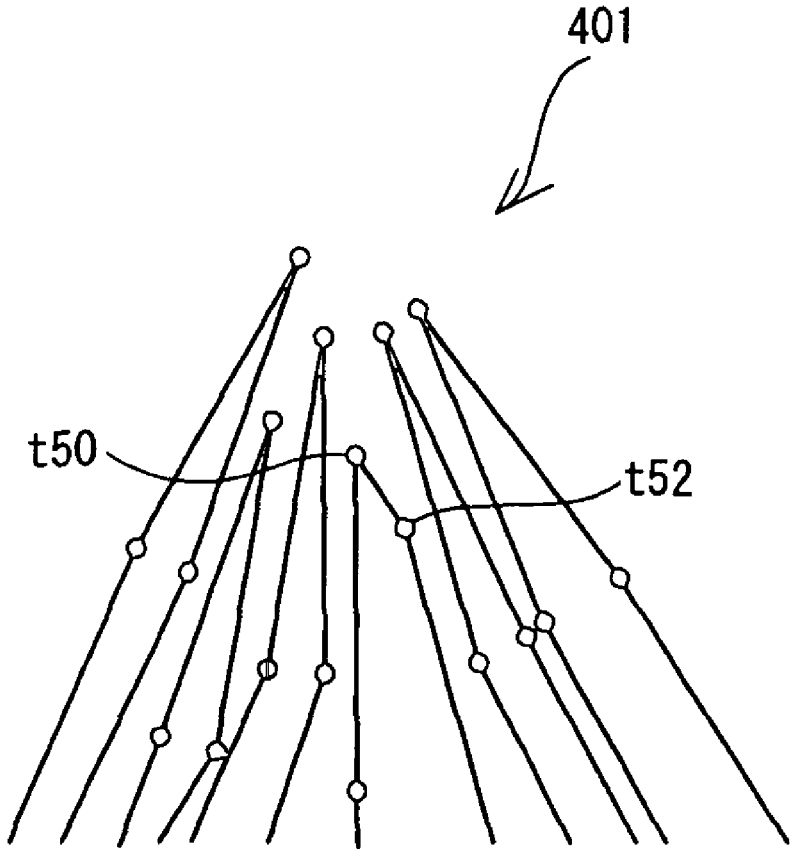
FIG. 12 is a schematic view depicting a state in which a turning point is deleted and adjusted.

Referring now to FIG. 11 and FIG. 12, an example will be described in which the adjacent point exists in an area G, and an area internal turning point is deleted. Here, the determination of whether to make an adjustment relates to the area internal turning point t51 shown in FIG. 11. Therefore, referring to the area G that serves a circle around the area internal turning point t51, the adjacent point t50 exists in the area G, and thus, the area internal turning point t51 is deleted. After deletion, as shown in FIG. 12, an end point of a stitch of which needle drop point t50 is defined as a start point is defined as t52.

Referring now to flowcharts of FIG. 13 to FIG. 15, a specific process for adjustment of a needle drop point will be described. At the time of creating embroidery data, a main process may be executed as a preprocess for creating embroidery data which is read into an embroidery sewing machine 3 when creation of embroidery data on the displayed embroidery sewing result is instructed in an embroidery data creation screen (not shown) used at the time of editing embroidery data. The values of the storage areas of the RAM 12 each may be initialized when the main process is started, and all "0"s are stored.

Figure 13:
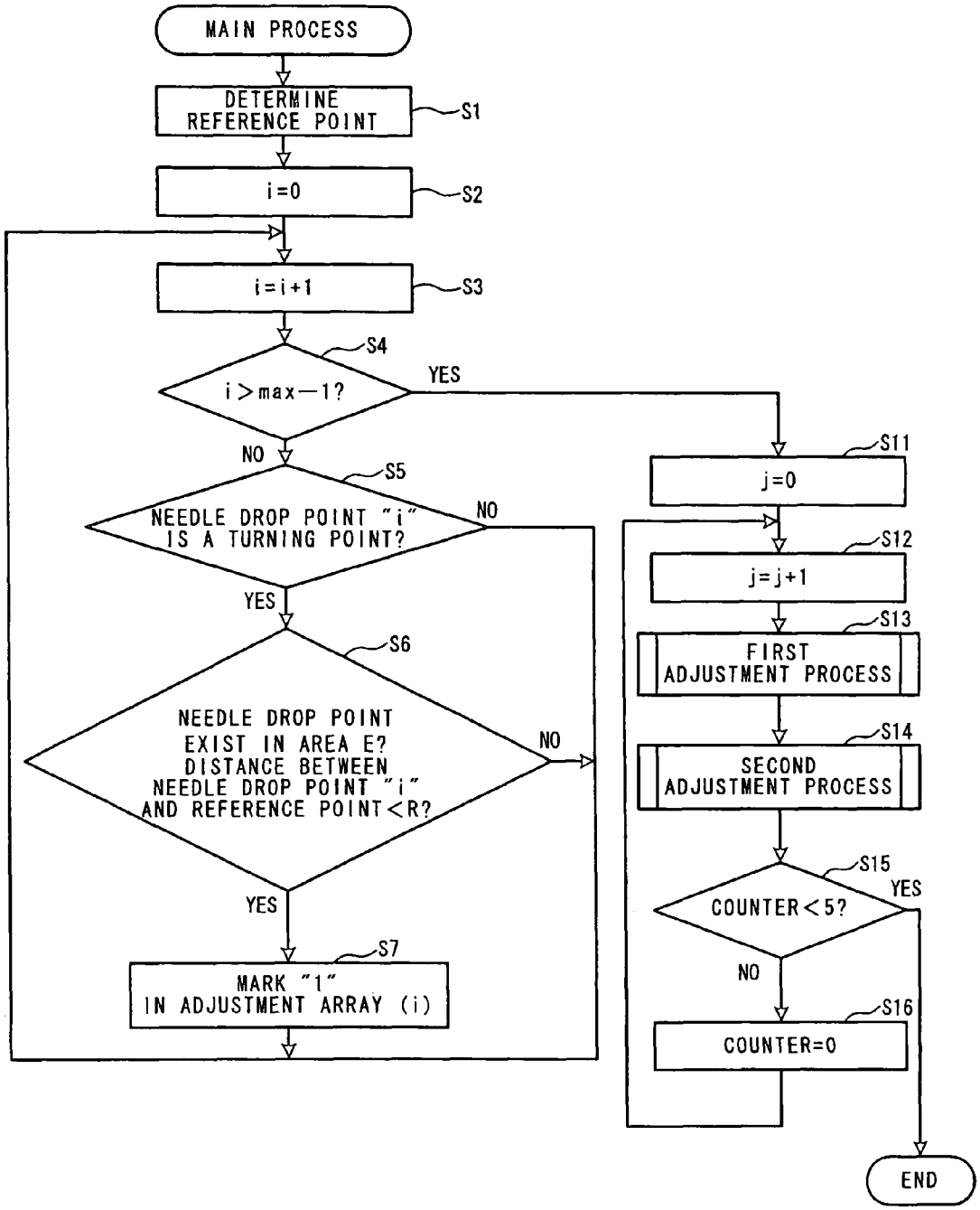
FIG. 13 is a flowchart of a main process for making adjustment of a needle drop point.
Figure 14:
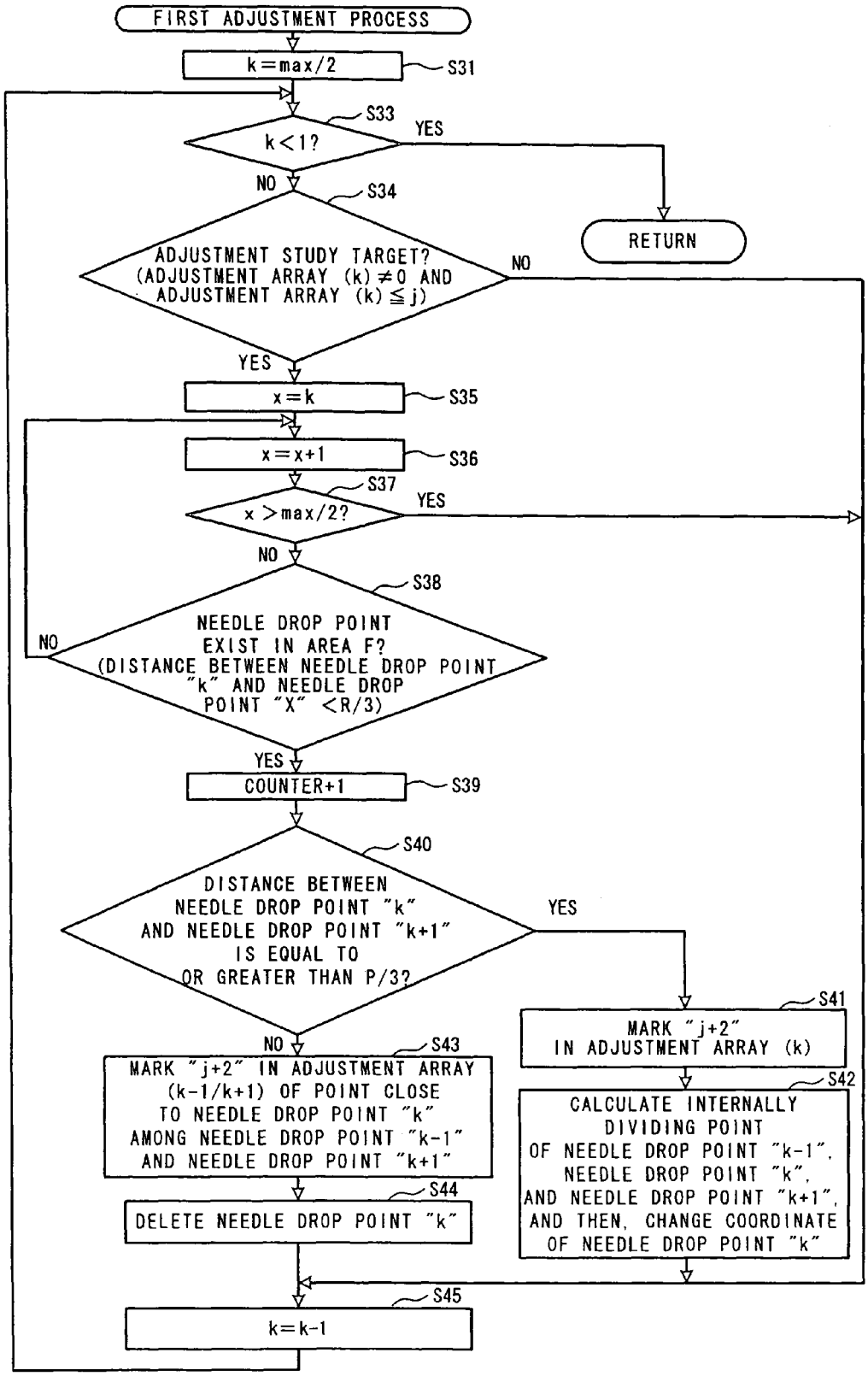
FIG. 14 is a flowchart of a first process to be carried out in the main process.

As shown in FIG. 13, in the main process, a reference point may first determined, and then, the coordinate of the reference point may be stored in a reference point coordinate storage area 121 (S1). Specifically, a first needle drop point of an embroidery stitch, a first turning point, a last turning point, and a last needle drop point may be defined as reference points. The coordinate of the first needle drop point may be defined as a coordinate stored in an embroidery coordinate array (1) and the coordinate of the last needle drop point may be defined as a value stored in an embroidery coordinate array (max). Then, judgment may be made as to whether the first turning points are turning points sequentially from embroidery coordinate array (2) to embroidery coordinate array (3), and then, a search may be made therefor. In judgment of whether a second needle drop point of which coordinate is stored in embroidery coordinate array (2) is a turning point, an angle produced by defining embroidery coordinate array (2) as a top point may be calculated at three points of embroidery coordinate array (1), embroidery coordinate array (2), and embroidery coordinate array (3), and then, judgment may be made depending on whether the angle is equal to or smaller than 45 degrees. The coordinate of a needle drop point first judged to be a turning point may be stored as a reference point in a reference point coordinate storage area 121. In addition, the last turning points may be searched sequentially from embroidery coordinate array (max−1) to embroidery coordinate array (max−2), and then, the coordinate of a needle drop point first judged to be a turning point may be stored as a reference point in the reference point coordinate storage area 121. Here, an area distance R may be calculated, and then, the calculated distance may be stored in the area distance storage area 124. This area distance R is defined, in the present embodiment, as "2×10/thread density" and then, a distance between a respective reference point and the needle drop point may be calculated with respect to all of the reference points.

If a reference point is determined in S1, a default value "0" may be stored in subscript variable "i" used as a subscript of an embroidery coordinate (S2). Then, the processes in S3 to S7 may be repeated, and, with respect to embroidery coordinate array (i), judgment may be made as to whether a needle drop point of that coordinate is targeted for study of adjustment. In the case where the needle drop point is targeted for adjustment, marking may be carried out.

Specifically, first, "1" may be added to subscript variable "i", and "1" may be set (S3). Then, judgment may be made as to whether a value of subscript variable "i" is greater than a value that is smaller than the number of needle drop points by "1" (S4). This judges whether marking has terminated up to a value that precedes the end of the embroidery coordinate array by one, namely, up to a needle drop point that precedes the last needle drop point. With respect to the last needle drop point, no adjustment is generally made, and thus, there is generally no need for marking. The subscript variable "i" may be set at "1", and thus, it may be judged that the variable is not greater than a value that is smaller than the number of needle drop points by "1" (S4: NO). Judgment may be made as to whether a needle drop point of which coordinate is stored in embroidery coordinate array (i) is a turning point (S5). As described previously, in judgment as to whether the needle drop point is a turning point, it may be judged that the needle drop point is a turning point in the case where an angle formed by three points, the needle drop point at issue and the preceding and succeeding needle drop points, is equal to or smaller than 45 degrees. Here, an angle of which needle drop point "i" formed by three points, embroidery coordinate array (i−1), embroidery coordinate array (i), and embroidery coordinate array (i+1), are defined as a top point, may be used. Hereinafter, a needle drop point of a coordinate stored in embroidery coordinate array (i) is indicated as needle drop point "i".

If needle drop point "i" is judged to be a turning point (S5: YES), the current process may proceed to step S6. On the other hand, if the above needle drop point is not judged to be a turning point (S5: NO), it may not be judged that the above needle drop point is targeted for study of adjustment. Then, the current process may revert to step S3 in which a process is carried out with respect to a next needle drop point. In the case of i=1, the needle drop point is a start point, and an angle cannot be formed. Thus, it may not be judged that the point is a turning point (S5: NO), the above needle drop point may not be targeted for study of adjustment, and then, the current process may revert to step S3. For example, in the example shown in FIG. 6, it is judged that needle drop points t2, t5, t8, t11, t14, t17 are turning points, and it is not judged that needle drop points t1, t3, t4, t6, t7, t9, t10, t12, t13, t15, t16, t18 are turning points.

Then, in the case where it is judged that needle drop point "i" is a turning point in step S5 (S5: YES), judgment of whether the needle drop point exists in an area E may be made depending on whether a distance between needle drop point "i" and a reference point is smaller than area distance R stored in the area distance storage area 124 (S6). In a case where a plurality of reference points exist, all of the reference points may be compared with the area distance R calculated with respect to their respective reference points. Even if there exists one area distance R of which distance between needle drop point "i" and a reference point is smaller, it may be judged that the reference point exists in the area E (S6: YES); "1" may be stored in adjustment array (i), and then, the stored point may be tagged for study of adjustment (S7). Then, the current process may revert to step S3 in which a process is carried out with respect to a next needle drop point. In addition, with respect to all of the reference points, if a distance to one of the reference points is greater than the area distance R (S6: NO), the distance may not be targeted for study of adjustment, and then, the current process may revert to step S3. In the example shown in FIG. 7, it is judged that all needle drop points t2, t5, t8, t11, t14, t17 exists in the area E.

When the current process reverts to step S3, "1" may be added to subscript variable "i", and then, "2" may be set (S3). As a result, it may be judged that the subscript variable "i" is not greater than a value that is smaller than the number of needle drop points by "1" (S4: NO), and then, judgment may be made as to whether a second needle drop point is targeted for study of adjustment (S5 to S7). Then, the processes of S3 to S7 may be carried out, and then, judgment may be made as to whether all of the needle drop points other than the last needle drop point is targeted for study of adjustment. With respect to the needle drop points targeted for study of adjustment, if "1" is stored in adjustment array (i), the value of subscript variable "i" is greater than a value that is smaller than the number of needle drop points by "1" (S4: YES), and then, the current process may proceed to step S11.

In step S11, a default value "0" may be stored in mark level variable "j". This mark level variable "j" may be provided as a value for comparison with a mark level of adjustment array stored in the adjustment array storage area 122. This is because, in a first time adjustment process (S13, S14), adjustment may be made as to a needle drop point at which a mark level is not set at "0" and a mark of which mark level is equal to or smaller than "1" is made, and, in a second time adjustment process, adjustment may be made as to a needle drop point at which a mark of which mark level is equal to or smaller than "2" is made. Next, "1" may be added to mark level variable "j", and then, "1" may be set (S12). Namely, this means that an adjustment process (S13, S14) may be made as to a needle drop point targeted for adjustment, of which mark level is equal to or smaller than "1" instead of "0".

Then, a first adjustment process (S13) and a second adjustment process (S14) may be out. In the present embodiment, needle drop points are divided into two groups, and then, the adjustment processes are carried out. Specifically, in this embodiment, these two groups are a first group of a "max/2"-th needle drop point from a first needle drop point of embroidery coordinate array and a second group of a last needle drop point from "max/2"-th needle drop point. Adjustment may be made as to a needle drop point of the first group by means of the first adjustment process (S13), and then, adjustment may be made as to a needle drop point of the second group by means of the second adjustment process (S14). Here, a description will be given by way of example described in FIG. 16. Here, for the sake of simplification, 30 needle drop points are provided. In an example of schematic view 700 of FIG. 16, the first group consists of m1 to m15, and the second group consists of m15 to m30.

Referring now to a flowchart of FIG. 14, the first adjustment process will be described. In this first adjustment process, with respect to embroidery coordinate array, processing may proceed for "max/2−1"-th needle drop point and "max/2−2"-th needle drop point sequentially in order from the max/2-th needle drop point, and then, study of adjustment and implementation of adjustment up to the first needle drop point may be carried out. In the example shown in FIG. 16, the process is carried out sequentially in order of the needle drop point m15, the needle drop point m14, the needle drop point m13, . . . the needle drop point m3, the needle drop point m2, and the needle drop point m1. Referring now to an example of FIG. 16, the first adjustment process while max=30 will be described. In the example shown in FIG. 16, the turning points are defined as m3, m8, m13, m18, m23, and m28. In step S6 of the main process, it may be judged that all of the turning points are targeted for study of adjustment; and it may be assumed that "1" is stored in adjustment array and that "0" is stored in adjustment array of other needle drop points.

First, a default value "max/2=15" may be stored in subscript variable "k" (S31). The value of subscript variable "k" is defined as a subscript of embroidery coordinate array. Next, judgment may be made as to whether the value of subscript variable "k" is smaller than "1" (S33). In other words, judgment may be made as to whether a process up to a last needle drop point to be carried out in this first adjustment process has terminated. The value of subscript variable "k" is set at "15", which is not smaller than "1" (S33: NO), and thus, judgment may be made as to whether needle drop point "k" is targeted for study of adjustment (S34). Specifically, judgment may be made as to whether a value marked for needle drop point "k" is equal to or smaller than mark level variable "j" instead of "0", in other words, as to whether a value equal to or smaller than "1" is marked, or alternatively, as to whether a value of adjustment array (k) is equal to or smaller than value "1" of mark level variable "j" instead of "0". It may be judged that the value of adjustment array (k) is set at "0", and is not targeted for study of adjustment (S34: NO), and then, "1" is subtracted from "k" in order to carry out a process relevant to a next needle drop point (S45). Then, the current process may revert to step S33.

Figure 16:
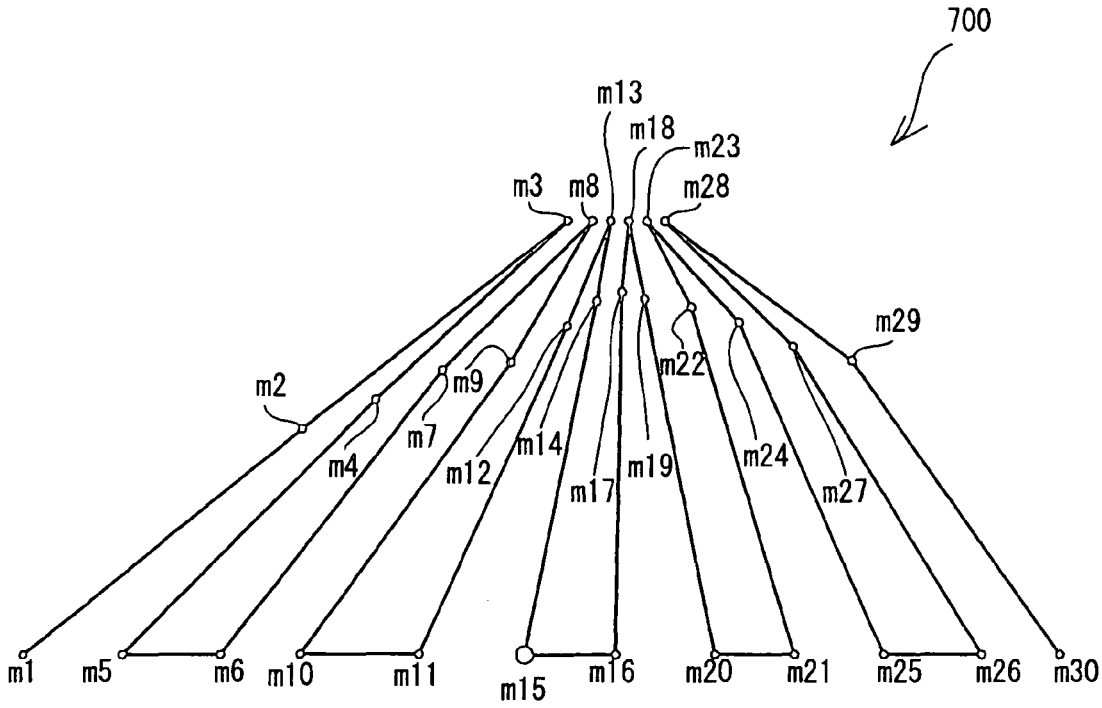
FIG. 16 is a schematic view of an embroidery result obtained by connecting needle drop points.

In the example illustrated in FIG. 16, m15 (k=15) is not targeted for study of adjustment, and "0" may be stored in adjustment array (15) (S34: NO). Thus, "1" may be subtracted from a value of subscript variable "k", and then, "14" is set (S45). Then, in step S33, it may be judged that the setting is not smaller than "1" (S33: NO), and then, judgment may be made as to whether needle drop point m14 (k=14) is targeted for study of adjustment. However, "0" may be stored in adjustment array (14), and then, it may be judged that the above needle drop point is not targeted for study of adjustment (S34: NO). "1" may be subtracted from a value of subscript variable "k", and then, "13" is set (S45). Then, the current process may revert to step S33. In step S33, it may be judged that the setting is not smaller than "1" (S33: NO), and then, adjustment may be made as to whether needle drop point m13 (k=13) is targeted for study of adjustment (S34). "1" may be stored in adjustment array (13), and then, the setting may be smaller than "1" instead of "0", and then, it may be judged that the above needle drop point is targeted for study of adjustment (S34: YES).

In a case where a value of adjustment array (k) is set at "1" and is equal to or smaller than a value of mark level variable "j" instead of "0", a needle drop point may be targeted for study of adjustment (S34: YES), and then, study of adjustment and actual adjustment may be made (S35 to S44). Then, a value of subscript variable "k" may first be stored as a default value in subscript variable "x" (S35). This subscript variable "x" is intended to verify whether a needle drop point exists in an area of a distance smaller than a first reference distance "R/3" from the needle drop point "k" judged to be targeted for study of adjustment, in other words, in an area F serving as a circle of radius "R/3" around a needle drop point "k".

In the present embodiment, needle drop points belonging to the first group may be divided into two groups. Then, in accordance with a sequential order of advancement of needle drop point "k", the above needle drop points may be divided into a preceding group of needle drop points that precede needle drop point "k" in sequential order and a succeeding group of needle drop points that succeed needle drop point "k" in sequential order. In this first process, subscript variable "k" may proceed from "max/2" to "1". Thus, as long as the value of subscript variable "k" is "13 (max/2>13>1)", the needle drop points may be divided into the preceding group of "max/2" to "14" and the succeeding group of "12" to "1". Then, subscript variable "x" may take a value indicating only a needle drop point belonging to this preceding group. Namely, this variable may take a value of "14" to "max/2".

Specifically, after value "13" of subscript variable "k" has been stored as a default value (S35), "1" may be added to the subscript variable (S36). Then, judgment may be made as to whether the value of subscript variable "x" is greater than "max/2" (S37). If the value of subscript variable "x" is not greater than "max/2" (S37: NO), a distance between needle drop point "k" and needle drop point "x" may be calculated; the calculated distance may be compared with a first reference distance "R/3"; and then, judgment may be made as to whether needle drop point "x" exists in the area F (S38). If a distance between needle drop point "k" and needle drop point "x" is not smaller than the first reference distance "R/3", needle drop point "x" does not exist in the area F (S38: NO), and there is a need for continuing a search as to whether another needle drop point exists in the area F. Then, the current process may revert to step S36 in which judgment is made as to whether next needle drop point "x" exists in the area F (S36, S37, S38).

On the other hand, if a distance between needle drop point "k" and needle drop point "x" is smaller than the first reference distance "R/3", needle drop point "x" exists in the area F (S38: YES), and then, needle drop point "k" may be targeted for adjustment. Then, "1" may be added to an adjustment number counter (S39). Then, judgment may be made as to which process to make adjustment (S40). Specifically, a distance between needle drop point "k" and needle drop point "k+1" may be calculated and then, the calculated distance may be compared with second reference distance "P/3". If the distance between needle drop point "k" and needle drop point "k+1" is equal to or greater than the second reference distance "P/3" (S40: YES), a process for moving needle drop point "k" (for changing a coordinate) may be selected. Therefore, "value of mark level variable "j"+2" may be stored in adjustment array (k) (S41). Currently, the value of mark level variable "j" is set at "1", and thus, "3" is stored. Then, an internally dividing point of three needle drop points "k−1", "k", and "k+1" may be calculated, and then, the calculated point may be stored in embroidery coordinate array (k) (S42). In other words, a position of needle drop point "k" is moved. A method for calculating an internally dividing point will be described later with reference to FIG. 17. Then, "1" may be subtracted from "k" in order to carry out a process relevant to next needle drop point (S45), and the current process may revert to step S33.

On the other hand, if a distance between needle drop point "k" and needle drop point "k+1" is not equal to or greater than a second reference distance "P/3" (S40: NO), a process for deleting needle drop point "k" may be selected. Therefore, a distance between needle drop point k−1 adjacent to needle drop point "k" and needle drop point "k" and a distance between needle drop point k+1 adjacent to needle drop point "k" and needle drop point "k" may first be calculated, and then, "value of mark level variable "j"+2" may be stored in adjustment array relevant to needle drop point of which distance relevant to needle drop point "k" is shorter. Namely, in the case where needle drop point k−1 is shorter, "value of mark level variable "j"+2" may be stored in adjustment array (k−1). In the case where needle drop point k+1 is shorter, "value of mark level variable "j"+2" may be stored in adjustment array (k+1) (S43). Then, needle drop point "k" may be deleted (S44). Specifically, values of embroidery coordinate array (k+1) to embroidery coordinate array (max) may be stored in embroidery coordinate array (k) to embroidery coordinate array (max−1), and then, a value that cannot be taken in coordinate of needle drop point, for example, "99999" or the like may be stored in embroidery coordinate array (max). Then, "1" may be subtracted from needle drop point number "max" stored in the needle drop point number storage area 123. "1" may be subtracted from "k" in order to carry out a process relevant to next needle drop point (S45), and then, the current process may revert to step S33.

After the processes of steps S36 to S38 have been carried out, if a value of subscript variable "x" is greater than "max/2" (S37: YES), another needle drop point does not exist in the area F. In other words, a process for maintaining a coordinate of a turning point may be selected; "1" may be subtracted from subscript variable "k" without making adjustment (S45); and the current process may revert to step S33. Then, a process relevant to next needle drop point "k" may be carried out.

In an example shown in FIG. 16, because subscript variable k=13, after a value "13" of subscript variable "k" has been stored as a default value (S35), "1" is added to subscript variable "x", and "14" may be set (S36). Then, a value "14" of subscript variable "x" is not greater than "max/2=15" (S37: NO). Thus, either of a process for searching another needle drop point (S38: NO), a process for deleting needle drop point m13 (S38: YES, S40: NO), and a process for moving needle drop point m13 (S38: YES, S40: YES) may be selected based on a relationship (S38) between a distance between needle drop point m13 and needle drop point m14 and a first reference distance R/3 and a relationship (S40) between a distance between needle drop point m13 and needle drop point m14 and a second reference distance P/3, and then, a process according to each of these processes may be carried out. In a process for disabling change, the current process may move to step S36 without doing anything; in the deleting process, the current process may move to step S45 after steps S43 and S44, and in the moving process, the current process may move to step S45 after S41 and S42.

In a case where another needle drop point is searched (S38: NO), the current process may revert to step S36, "1" may be added to subscript variable "x", and then, "15" is set (S36). A value "15" of the subscript variable "x" is not greater than "max/2=15" (S37: NO), so a respective process may be carried out based on a relationship (S38) between a distance between needle drop point m13 and needle drop point m14 and a first reference distance R/3 and a relationship (S40) between a distance between needle drop point m13 and needle drop point m14 and a second reference distance P/3. In a case where another needle drop point is further searched (S38: NO), the current process may revert to step S36 in which "1" is added to subscript variable "x", and "16" may be set (S36). Because a value "16" of the subscript variable "x" is greater than "max/2=15" (S37: YES), another needle drop point may not be found in the area F. Therefore, with respect to needle drop point m13, a process for maintaining a coordinate may be selected, "1" may be subtracted from subscript variable "k", and "13" may be set (S45). Then, the current process may revert to step S33 in which a process relevant to next needle drop point "k" may be carried out.

In this way, the processes of S33 to S45 may be repeatedly carried out, and then, study of adjustment and implementation of adjustment from max/2-th needle drop point to a first needle drop point may be sequentially carried out. In an example shown in FIG. 16, "1" may be stored in adjustment array with respect to needle drop points m13, m8, m3, and thus, the processes of S35 to S44 may be carried out. At needle drop point m8, comparison of a distance relevant to a first reference process of S38 may be carried out until a needle drop point of which distance is shorter than a first reference distance appears in sequential order of needle drop points m9, m10, m11, m12, m13, m14, m15. Namely, comparison with a first reference distance may be carried out with respect to needle drop points of the preceding group in which adjustment has been already been made. Therefore, judgment may be made as to whether to make adjustment, and thus, comparison may be carried out with respect to needle drop points in a state in which needle drop points are not dense and in a state in which thread density is lowered. Therefore, needle drop points become sparse in comparison with needle drop points of a succeeding group in which adjustment is not made yet, and thus, needle drop points are not adjusted more than necessary.

As shown in FIG. 13, when a first adjustment process terminates in a main process (S13), a second adjustment process may be carried out (S14). In the second adjustment process, with respect to embroidery coordinate array, processing may proceed in sequential order of "max/2+1"-th needle drop point and "max/2+2"-th needle drop point from max/2-th needle drop point, and then, study of adjustment and implementation of adjustment may be carried out up to "max"-th needle drop point. In an example shown in FIG. 16, processing may be carried out in sequential order of needle drop point m15, needle drop point m16, needle drop point m17, . . . , needle drop point m28, needle drop point m29, and needle drop point m30.

Figure 15:
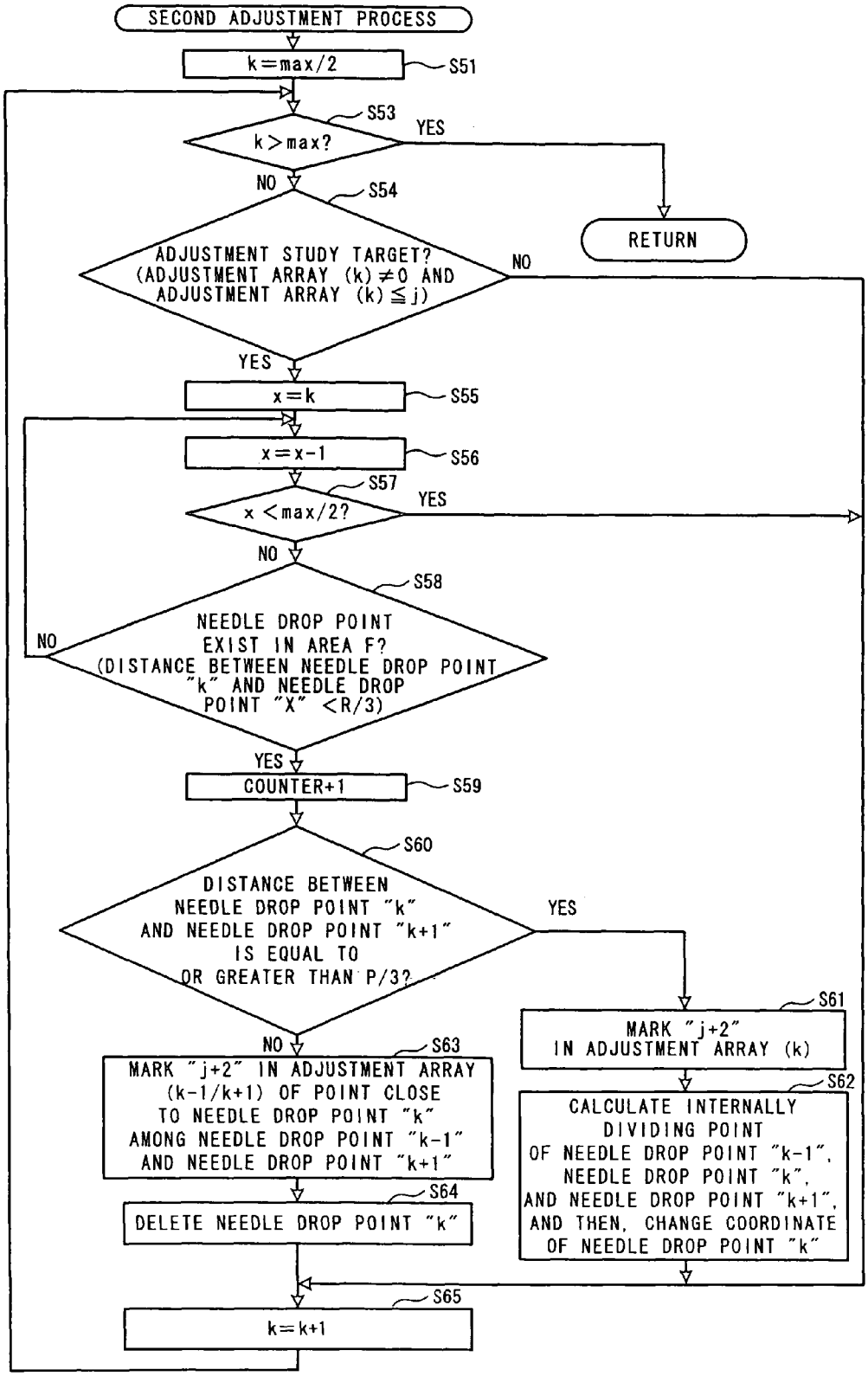
FIG. 15 is a flowchart of a second process to be carried out in the main process.

As shown in FIG. 15, first, a default value "max/2=15" may be stored in subscript variable "k" (S51). Then, judgment may be made as to whether a value of subscript variable "k" is greater than "max" (S53). In other words, judgment may be made as to whether a process up to the last needle drop point to be carried out in this first adjustment process has terminated. The value of subscript variable "k" may be set at "15", which is not greater than "30" (S53: NO), and thus, judgment may be made as to whether needle drop point "k" is targeted for study of adjustment (S54). Specifically, judgment may be made as to whether a value marked with needle drop point "k" is not set at "0" and a value equal to or smaller than a value of mark level variable "j", in other words, a value equal to or smaller than "1" instead of "0" is marked. A value of adjustment array (k) is set at "0", it may be judged that the needle drop point is not targeted for study of adjustment (S54: NO), "1" is added to "k" in order to carry out a process relevant to next needle drop point (S65), and then, the current process may revert to step S53.

In the example of FIG. 16, m15 (k=15) is not targeted for study of adjustment, and "0" may be stored in adjustment array (1) (S54: NO). Thus, "1" may be added to subscript variable "k", and "16" may be set (S65). In step S53, it may be judged that the setting is not greater than "max" (S53: NO), and then, judgment may be made as to whether needle drop point m16 (k=16) is targeted for study of adjustment. "0" may be stored in adjustment array (16) (S54: NO), so "1" may be added to a value of subscript variable "k", "17" is set (S65), and then, the current process may revert to step S53. Then, in step S53, it may be judged that the value of subscript variable "k" is not greater than "max" (S53: NO), and then, judgment may be made as to whether needle drop point m18 (k=18) is targeted for study of adjustment (S54). "1" may be stored in adjustment array (18), and thus, it may be judged that the needle drop point is equal to or greater than "1", and is targeted for study of adjustment (S54: YES).

In the case where a value of adjustment array (k) is "1" and a value of mark level variable "1" is equal to or smaller than "1" and is not "0", the needle drop point may be targeted for study of adjustment (S54: YES), and then, study of adjustment and actual adjustment may be made (S55 to S56). Then, a value of subscript variable "k" may be stored as a default value in subscript variable "x" (S55). This subscript variable "x" is intended to verify whether there exists a needle drop point in an area of a distance that is less than a first reference distance "R/3" from needle drop point "k" judged to be targeted for study of adjustment, in other words, in an area F that serves as a circle of radius "R/3" around needle drop point "k", as in the first adjustment process.

In the present embodiment, needle drop points belonging to a second group may be divided into two groups. Then, in accordance with a sequential order of advancement of needle drop point "k", the needle drop points may be divided into a preceding group of needle drop points that precede the needle drop point "k" in sequential order and a succeeding group of needle drop points that succeeds the needle drop point "k" in sequential order. In this first process, subscript variable "k" advances from "max/2" to "max". Thus, if the value of subscript variable "k" is "18 (max/2<18<max)", the needle drop points may be divided into a preceding group of "max/2" to "17" and a succeeding group of "19" to "max". Then, subscript variable "x" may take a value indicating only a needle drop point that belongs to this preceding group. Namely, a value of "max/2" to "17" is taken.

Specifically, after a value "18" of subscript variable "k" has been stored as a default value (S55), "1" may be subtracted from subscript variable "x" (S56). Then, judgment is made as to whether the value of subscript variable "x" is smaller than "max/2" (S57). If the value of subscript variable "x" is not smaller than "max/2" (S57: NO), a distance between needle drop point "k" and needle drop point "x" may be calculated, the calculated distance may be compared with a first reference distance "R/3", and then, judgment may be made as to whether needle drop point "x" exists in the area F (S58). If the distance between needle drop point "k" and needle drop point "x" is not shorter than the first reference distance "R/3", needle drop point "x" exists in the area F (S58: NO), and there may be a need for continuing a search as to whether another needle drop point exists in the area F. Then, the current process may revert to step S56 in which judgment may be made as to whether next needle drop point "x" exists in the area F (S56, S57, S58).

On the other hand, if a distance between needle drop point "k" and needle drop point "x" is shorter than a first reference distance "R/3", needle drop point "x" exists in the area F (S58: YES), and then, needle drop point "k" may be targeted for adjustment. Then, "1" may be added to the adjustment point number counter (S59). Then, judgment may be made as to which process to make adjustment (S60). Specifically, a distance between needle drop point "k" and needle drop point "k−1" may be calculated, and then, the calculated distance may be compared with a second reference distance "P/3". If the distance between needle drop point "k" and needle drop point "k−1" is equal to or greater than the second reference distance "P/3" (S60: YES), a process for moving needle drop point "k" (changing a coordinate) may be selected. Then, first, "a value of mark level variable j+2" may be stored in adjustment array (k) (S61). Currently, a value of mark level variable "j" may be set at "1", and thus, "3" may be stored. Then, an internally dividing point of three needle drop points "k−1", "k", and "k+1" may be calculated, and then, the calculated point may be stored in embroidery coordinate array (k) (S62). In other words, a position of needle drop point "k" is moved. "1" may be added to "k" in order to carry out a process relevant to next needle drop point (S65), and then, the current process may revert to step S53.

On the other hand, if a distance between needle drop point "k" and needle drop point "k+1" is not equal to or greater than the second reference distance "P/3" (S60: NO), a process for deleting needle drop point "k" may be selected. Then, a distance between each of needle drop points "k−1", "k+1" adjacent to needle drop point "k" and the needle drop point "k" may be calculated, respectively, and then, "value of mark level variable j+2" may be stored in adjustment array with respect to needle drop point of which distance relevant to needle drop point "k" is shorter. Namely, in the case where needle drop point "k−1" is shorter, "value of mark level variable j+2" may be stored in adjustment array (k−1). In the case where needle drop point "k+1" is shorter, "value of mark level variable j+2" may be stored in adjustment array (k+1) (S63). Then, needle drop point "k" may be deleted (S64). Specifically, the values of embroidery coordinate array (k+1) to embroidery coordinate array (max) may be stored in embroidery coordinate array (k) to embroidery coordinate array (max−1), a value that cannot be taken on a needle drop point coordinate, for example, "99999" may be stored in embroidery coordinate array (max). Then, "1" may be subtracted from needle drop point number "max" stored in a needle drop point number storage area 123. "1" is added to "k" in order to carry out a process relevant to next needle drop point (S65), and then, the current process may revert to step S53.

After the processes of steps S56 to S58 have been repeatedly carried out, if the value of subscript variable "x" is smaller than "max/2" (S57: YES), another needle drop point does not exist in the area F. Thus, a process for maintaining a coordinate of a turning point may be selected, adjustment may not be made, "1" may be added to subscript variable "k" (S65), and then, the current process may revert to step S53 in which a process relevant to next needle drop point "k" may be carried out.

In the example shown in FIG. 16, because subscript variable k=18, after a value "18" of subscript variable "k" has been stored as a default value (S55), "1" may be subtracted from subscript variable "x", and then, "17" may be set (S56). Then, the value "17" of subscript variable "x" is not smaller than "max/2=15" (S57: NO). Thus, either of a process for searching another needle drop point (S58: NO), a process for deleting needle drop point m18 (S58; YES, S60: NO) and a process for moving needle drop point m18 (S58: YES, S60: YES) may be selected based on a relationship (S58) between a distance between needle drop point m18 and needle drop point m17 and the first reference distance R/3 and a relationship (S60) between a distance between needle drop point m18 and needle drop point m17 and the second reference distance P/3, and then, a process according to each of these processes may be carried out. In a process for maintaining a coordinate, the current process may move to step S56 without doing anything; in the deleting process, the current process may move to step S65 after steps S63 and S64, and in the moving process, the current process may move to step S65 after S61 and S62.

In the case where another needle drop point is searched (S58: NO), the current process may revert to step S56 in which "1" may be subtracted from subscript variable "x" and "16" is set (S56). Then, the value "16" of subscript variable "x" is not smaller than "max/2=15" (S57: NO), so a respective process may be carried out based on a relationship between a distance between needle drop point m18 and needle drop point m16 and the first reference distance R/3 (S58) and a relationship between a distance between needle drop point m18 and needle drop point m16 and the second reference distance P/3 (S60). In addition, in a case where another needle drop point is further searched (S58: NO), the current process may revert to step S56 in which "1" may be subtracted from subscript variable "x" and "15" is set (S56). Then, the value "15" of subscript variable "x" is not smaller than "max/2=15" (S57: NO), and thus, a respective process may be carried out based on a relationship between a distance between needle drop point m18 and needle drop point m15 and the first reference distance R/3 (S58) and a relationship between a distance between needle drop point m18 and needle drop point m15 and a second reference distance P/3 (S60). In addition, in the case where another needle drop point is further searched (S58: NO), the current process may revert to step S56 in which "1" may be subtracted from subscript variable "x" and "14" is set (S56). The value "14" of subscript variable "x" is smaller than "max/2=15" (S57: YES), so "1"

may be added to subscript variable "k", and 19 may be set (S65). Then, the current process may revert to step S53 in which a process relevant to next needle drop point "k" may be carried out.

In this way, the processes of S53 to S65 may be repeatedly carried out, and then, study of adjustment and implementation of adjustment from max/2-th needle drop point to a first needle drop point may sequentially be carried out. In the example shown in FIG. 16, "1" may be stored in adjustment array with respect to needle drop points m18, m23, m28, and thus, the processes of S55 to S64 may be carried out. At needle drop point m23, comparison of a distance relevant to a first reference process of S58 may be carried out until a needle drop point of which distance is shorter than a first reference distance appears in sequential order of needle drop points m22, m21, m20, m19, m18, m17, m16, m15. Namely, comparison with a first reference distance may be carried out with respect to needle drop points of a preceding group in which adjustment has been already been made. Therefore, judgment may be made as to whether to make adjustment, and thus, comparison may be carried out with respect to needle drop points in a state in which needle drop points are not dense and in a state in which thread density is lowered. Therefore, needle drop points may become sparse in comparison with needle drop points of a succeeding group in which adjustment is not made yet, and thus, needle drop points are not adjusted more than necessary.

Then, as shown in FIG. 13, in a main process, when a second adjustment process terminates (S14), judgment may be made as to whether a value of the adjustment point number counter is smaller than "5" (S15). If the value is smaller than "5" (S15: YES), it may be judged that needle drop points at which the number of adjustment needle drop points is sufficiently small, namely, needle drop points existing around a reference point becomes properly sparse, and then, the main process may terminate.

However, if the value of the counter is not smaller than "5" (S15: NO), there may be a need for further adjusting a needle drop point, and thus, the value of the needle drop point number counter may be cleared to "0" (S16), and then, the current process may revert to S12. Then, "1" may be added to mark level variable "j", and "2" may be set (S12). In this manner, in step S34 of the first adjustment process and in step S54 of the second adjustment process, when judgment is made as to whether the needle drop point is targeted for this adjustment, adjustment may be made as to whether the value of adjustment array (k) of needle drop point "k" targeted for study of adjustment is equal to or smaller than a value of mark level variable "j" and may be set at a value other than "0". Although mark level variable "j" may be set at "2", "2" may be added to mark level variable "j" (1), and then, "3" may be stored with respect to the adjusted needle drop point "k" in a first time adjustment process (S12, S13). Thus, an adjustment may not be made in this second time adjustment process. In other words, next adjustment may not be made with respect to the adjusted needle drop points. In the case where needle drop point "k" has been deleted, although "3" may be stored as a substitute after deleted, in adjustment array (k+1) or adjustment array (k−1) of needle drop point "k+1" or needle drop point "k−1", next adjustment may not be made similarly. However, in the next to next adjustment process, mark level variable "j" may be set at "4". Thus, in step S34 of the first adjustment process and in step S54 of the second adjustment process, it may be judged that the setting is equal to or smaller than "4" and is not "0", and the needle drop point may be targeted for adjustment. In this manner, the same needle drop points may be adjusted many times, making it possible to avoid providing a gap in embroidery result.

Then, when "1" is added to mark level variable "j" in step S12, a first adjustment process (S13) and a second adjustment process (S14) may be made, and comparison with a value "5" of the adjustment point number counter may be made (S15). When the setting is not smaller than "5" (S15: NO), the current process may revert to step S12. In this manner, in the processes of step S12 to S16, when a value of the adjustment point number counter is smaller than "5" (S15: YES), and the needle drop points around all of the reference points becomes sufficiently sparse, the thread density is sufficiently lower, and then, a main process may terminate. Then, the coordinate values stored in the embroidery coordinate array may be used, and then, embroidery data may be created.

Figure 17:
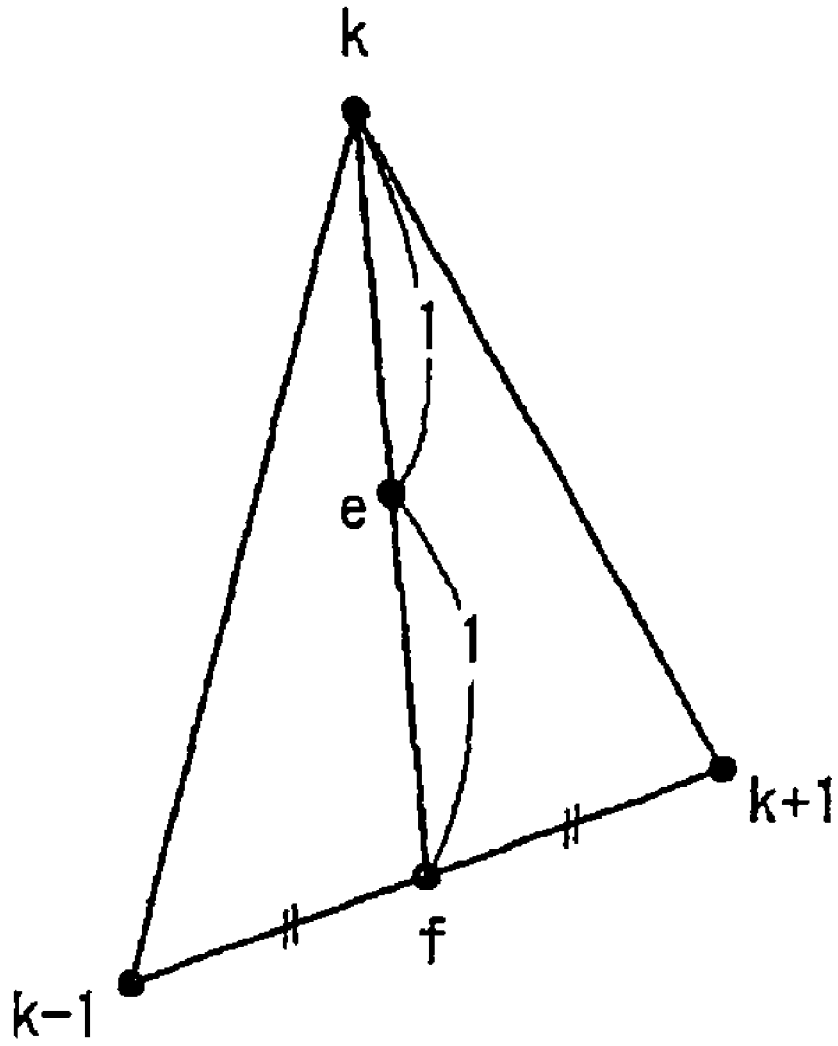
FIG. 17 is a schematic view depicting an internally divisional point caused by three needle drop points.

Referring now to FIG. 17, the calculation will be described of an internally dividing point to be carried in step S42 of the first adjustment process (FIG. 14) and in step S62 of the second adjustment process (FIG. 15). In a triangle consisting of three points "k−1", "k", and "k+1", a straight line connecting a top point "k" and a point "f" (a middle point of an opposite edge) may divide the opposite edge (straight line connecting needle drop points "k−1" and "k+1") into two sections. This line is referred to as a middle line. Then, a point for internally dividing this middle line "kf" at a predetermined ratio is defined as an internally dividing point "e". In an example shown in FIG. 17, a point for internally dividing the middle line "kf" into "ke:ef=1:1" is shown.

Figure 18:
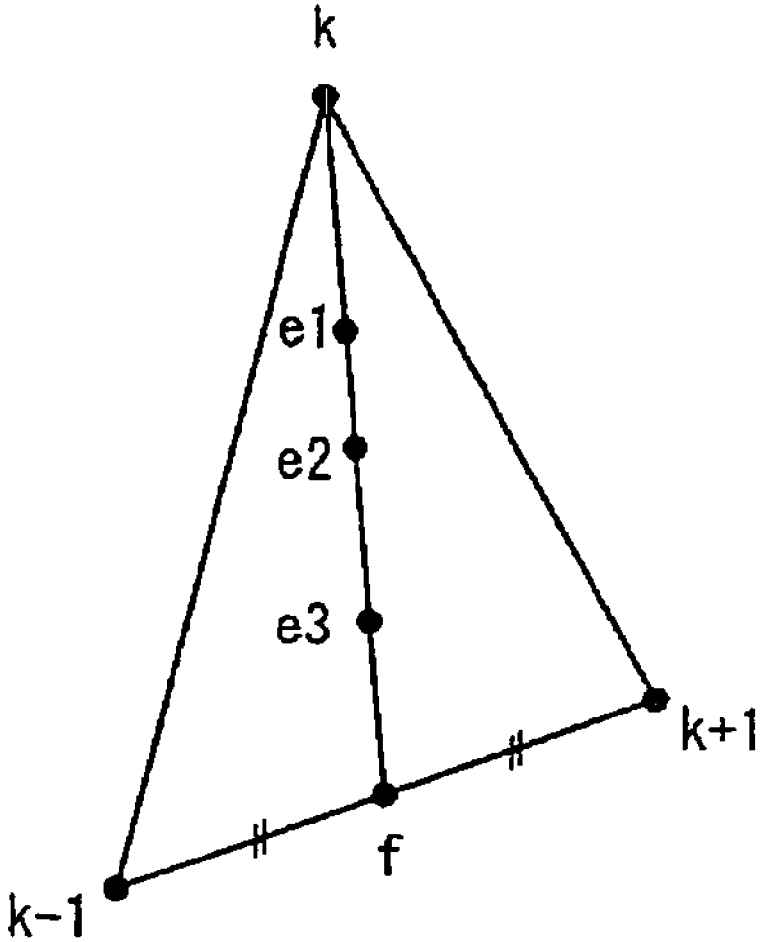
FIG. 18 is a schematic view depicting an internally divisional point caused by three needle drop points.
Figure 19:
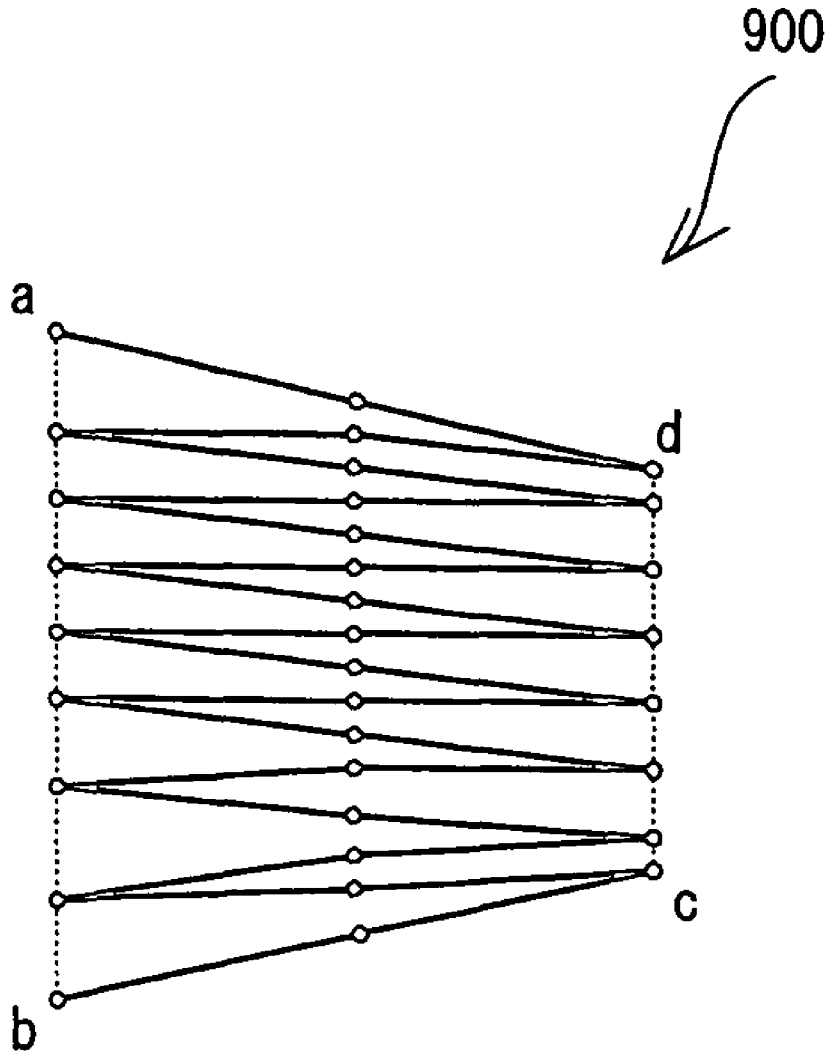
FIG. 19 RELATED ART
FIG. 19 is a schematic view depicting how to sew up an area.
Figure 20:
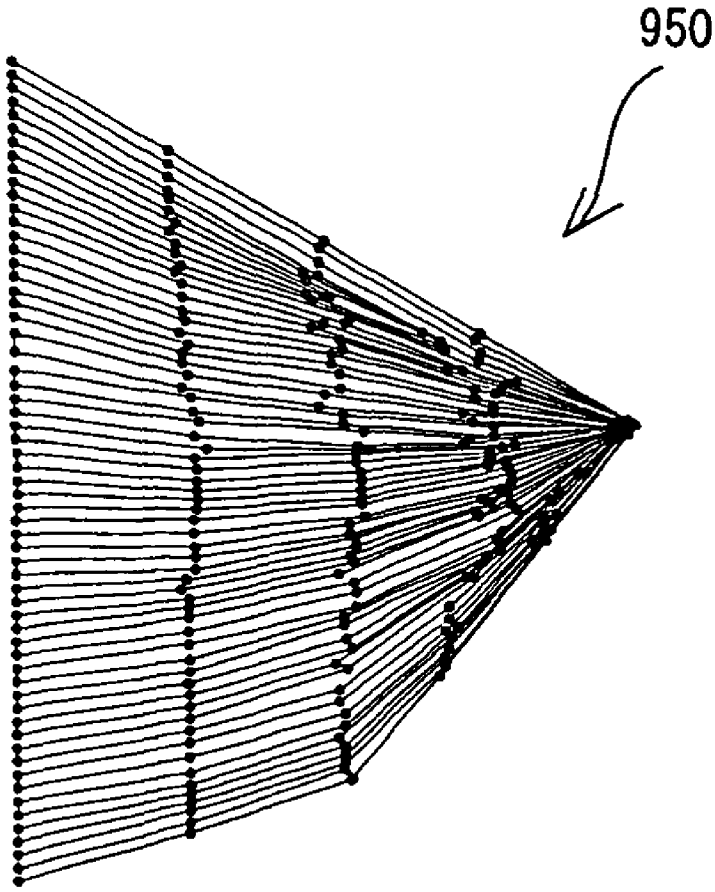
FIG. 20 RELATED ART
FIG. 20 is a schematic view depicting a stitch of which needle drop points are dense; and the needle drop points.

There is not always a need that a ratio of internally dividing points relative to this middle line "kf" is 1:1, and, of course, another ratio may be "ke:ef=1:2", "ke:ef=2:3", or "ke:ef=4:3". In addition, this ratio may be provided in plurality without being limited to one type. For example, as shown in FIG. 18, three internally dividing points of points "e1", "e2, "e3" may be provided. In an example shown in FIG. 18, "ke1:e1*f*=1:2", "ke2:e2*f*=1:1", "ke3:e3*f*=3:1" may be set. In such a case, a movement destination of a needle drop point may be selected as an internally dividing point "e1"; a movement destination of next needle drop point may be selected as an internally dividing point "e2"; a movement destination of next needle drop point may be selected as an internally dividing point "e3"; and a movement destination of next needle drop point may be selected as an internally dividing point "e1," . . . sequentially. By doing thus, a coordinate of a needle drop point of a movement destination may be dispersed. In addition, an appearance rate of this internally dividing point may not be uniform, and an internally dividing point of a low appearance rate may exist such as an internally dividing point "e1", an internally dividing point "e2", an internally dividing point "e3", an internally dividing point "e1", an internally dividing point "e2", an internally dividing point "e1", an internally dividing point "e2", an internally dividing point "e1", an internally dividing point "e2", an internally dividing point "e3", and an internally dividing point "e1". However, if the same internally dividing points are sequentially selected, the position of a needle drop point of a movement destination becomes proximal, and may not exhibit good dispersion. Thus, a sequential order may be such that the same internally dividing points do not appear sequentially many times.

As described above, among the turning points existing around a reference point at which needle drop points are prone to dense (center of reference point or in circle area E of radius R), a turning point at which another needle drop point exists in proximity (center of turning point or in circle area F of radius R/3) may be moved to a direction distant from a reference point (movement to an internally dividing point of a turning point) or may be decimated (deletion of turning point), whereby the density of needle drop points around the reference point can be made sparse, and then, the thread density can be made sparse. The density of needle drop points around any reference point may be adjusted similarly, thus not depending on the shape of an area sewn up by means of embroidery sewing. The density of needle drop points may be adjusted relative to the already created embroidery coordinate array. Thus, there is generally no need for creating the embroidery coordinate array from the start, problems are minimized, and a process is not complicated.

In this way, according to the embroidery data creation apparatus and the embroidery data creation program in this disclosure, in the case where needle drop points are dense around the reference point, the coordinate of these needle drop points can be changed, deleted, or kept unchanged, based on a positional relationship with another needle drop point, and then, the density of needle drop points around the reference point can be lowered. Therefore, a problem may be minimized where the needle drop points become dense and embroidery threads are formed bunching up together, thereby degrading the appearance of the sewn up embroidery pattern and lowering a sewing quality.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

For example, the embroidery data creation apparatus according to the present disclosure is not limited to the embodiments described above, and, of course, various modifications can occur without deviating from the spirit of the present disclosure. In the embodiments described above, a reference point is defined as a first needle drop point, a first turning point, a last turning point, or a last needle drop point without being limited thereto. In addition, a user can specify the reference point. In addition, in judging whether a needle drop point is a turning point, it may be judged that the needle drop point is a turning point in the case where an angle formed at three points between one's own needle drop point and each of the preceding and succeeding needle drop points is equal to or smaller than 45 degrees. This angle may be properly set without being limited to 45 degrees.

In addition, in the embodiment described above, in the case where the value of the adjustment point number counter is smaller than "5", a process has been terminated (main process, S15: YES). However, the value to be compared with the value of the adjustment point number counter may be equal to or greater than or may be smaller than "5" without being limited thereto. In addition, a user may be set the value or may determine it based on the thread density that may be stored in a setting information storage area 142. For example, in the case where the thread density is "4", then "5" is set, and in the case where the thread density is "5", then "7" is set. In other words, the values according to the thread density may be stored in advance.

In addition, although a circle of distance R (2×10/thread density) around a reference point is exemplified as a reference area from a reference point, the reference area is not limited thereto. At the time of calculating distance R, although "2×10/thread density" may be set, a method for calculating distance R may be set at a value considering thread thickness or pitch length without being limited thereto. For example, a thread thickness coefficient may be predetermined every thread thickness, and "2×10/thread density×thread thickness coefficient" may be set. The thread thickness coefficients may be set at "0.8" in thread smaller than 75 D (denier), may be set at "1.0" in thread equal to or greater than 75 D and smaller than 150 D, may be set at "1.2" equal to or greater than 150 D. In addition, the shape of a reference area may be a polygon such as, for example, a rectangle or an ellipse without being limited to the circle.

In addition, although "R/3" is used as a first reference distance, this value is not limited thereto. The first reference distance may be "R/4" or "R/2". With respect to this distance R, as in the case of the reference area, a value considering thread thickness or pitch length may be set. In addition, although "P/3" is used as a second reference distance, this value is not limited thereto. A value considering thread density or thread thickness may be set without being limited to pitch length.

In the illustrated embodiment, the controller (CPU11) preferably may be implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the disclosure.

While the disclosure has been described with reference to exemplary embodiments, it is to be understood that the disclosure is not limited to the exemplary embodiments or constructions. While the various elements of the exemplary embodiments are shown in various combinations and configurations, which are exemplary, other combinations and configurations, including more, less or only a single element, are also within the spirit and scope of the disclosure.

What is claimed is:

1. An embroidery data creation apparatus comprising:

an embroidery coordinate storage device that stores a coordinate of a needle drop point serving as a start point or an end point of an embroidery stitch;

a turning point judgment device that judges whether the needle drop point of the coordinate stored in the embroidery coordinate storage device is a turning point by determining whether an angle of the needle drop point is smaller than a predetermined quantity, where the angle is defined by a preceding stitch of which the needle drop point serves as an end point and a succeeding stitch of which the needle drop point serves as a start point;

a reference point determination device that determines at least one reference point from a needle drop point that is judged to be the turning point;

an area determination device that determines a predetermined area around the needle drop point that is determined to be the reference point, where the predetermined area is based on at least one of thread density of the embroidery sewing, thread thickness, and a pitch length of a stitch;

an area internal turning point judgment device that judges whether the turning point is in the predetermined area;

an adjustment process selection device that selects, in a case where it is judged that the turning point is in the predetermined area, any one of the following adjustment processes:

a process for maintaining a coordinate of the turning point, a process for changing a coordinate of the turning point, and a process for deleting the turning point wherein the adjustment process is selected based on a coordinate position relationship between the turning point and another needle drop point having a coordinate that is stored in the embroidery coordinate storage device; and an adjustment control device that:

calculates a new coordinate of the turning point that the process for changing the coordinate is selected, where the new coordinate is calculated based on a coordinate of the turning point that the process for changing the coordinate is selected and coordinates of at least two needle drop points adjacent to the turning point that the process for changing the coordinate is selected, and deletes the turning point that a process for deleting is selected.

2. The embroidery data creation apparatus as claimed in claim 1, wherein the adjustment process selection device comprises:

a negative change selection control device that selects a process for maintaining a coordinate relative to the turning point at which the selection will be made, based on a positional relationship between the turning point at which the selection will be made and another needle drop point having a coordinate that is stored in the embroidery coordinate storage device;

a change deletion selection control device that selects a process for changing a coordinate of the turning point or a process for deleting the turning point, based on a positional relationship between the turning point at which the selection will be made and a needle drop point adjacent to the turning point at which the selection will be made, in a case where a process for maintaining a coordinate is not selected by the negative change selection control device for the turning point at which the selection will be made.

3. The embroidery data creation apparatus as claimed in claim 2, wherein the adjustment process selection device comprises:

a first reference distance calculation device that calculates a first reference distance based on at least one of thread density of the embroidery sewing, thread thickness, and a pitch length of a stitch; and a second reference distance calculation device that calculates a second reference distance based on at least one of thread density of the embroidery sewing, thread thickness, and a pitch length of a stitch;

the negative change selection control device selects a process for maintaining a coordinate relative to the turning point at which the selection will be made in the case where there is no needle drop point having a distance from the turning point at which the selection will be made that is shorter than the first reference distance, from among needle drop points having a coordinate stored in the embroidery coordinate storage device; and the change deletion selection control device selects a process for changing a coordinate of the turning point in a case where a distance between the turning point at which the selection will be made and a needle drop point adjacent to the turning point at which the selection will be made is equal to or longer than the second reference distance, and selects a process for deleting the turning point in the case where the distance is not equal to or greater than the second reference distance.

4. The embroidery data creation apparatus as claimed in claim 1, further comprising:

an adjustment number counting device that counts the number of the turning points that the process for changing the turning point or the process for deleting the turning point is selected, from among area internal turning points which are defined as turning points judged to be in the predetermined area by the area internal turning point judgment device; and a repetition adjustment control device that repeatedly implements the adjustment process selection device and the adjustment control device relative to all of the area internal turning points until the number counted by the adjustment number counting device becomes smaller than a predetermined number.

5. The embroidery data creation apparatus as claimed in claim 4, wherein the repetition adjustment control device implements the adjustment process selection device and the adjustment control device relative to the area internal turning points, in a predetermined order that is based on a sequential order stored in the embroidery coordinate storage device;

and the negative change selection control device classifies needle drop points stored in the embroidery coordinate storage device into groups in which the predetermined order stored in the embroidery coordinate storage device precedes or succeeds the turning point at which the selection will be made, and then, makes comparison between a distance to the turning point at which the selection will be made and the first reference distance only with respect to a needle drop point that belongs to the group including the turning point on which the adjustment process selection device and the adjustment control device have been implemented.

6. The embroidery data creation apparatus as claimed in claim 4, wherein the repetition adjustment control device classifies the needle drop points stored in the embroidery coordinate storage device into at least two groups, and then, repeatedly implements the adjustment process selection device and the adjustment control device by each group with respect to the area internal turning points that belong to the groups.

7. The embroidery data creation apparatus as claimed in claim 1, wherein, when a new coordinate is calculated for the turning point that the process for changing the coordinate is selected, the adjustment control device treats, as a new coordinate of the turning point that the process for changing the coordinate is selected, a coordinate of an internally dividing point that serves as a point on a middle line serving as a line segment connecting the turning point that the process for changing the coordinate is selected and a middle point of a straight line connecting two needle drop points adjacent to the turning point that the process for changing the coordinate is selected with each other.

8. The embroidery data creation apparatus as claimed in claim 7, wherein a divisional ratio of internally dividing points relative to the middle line is provided in plurality, and the adjustment control device selects divisional ratios sequentially on a one by one basis from the plurality of divisional ratios every time a new coordinate of the turning point that the process for changing the coordinate is selected is calculated, and then determines a coordinate of the internally dividing point.

9. A computer readable recording medium including an embroidery data creation computer program, where the program comprises:

turning point judgment instructions for judging whether a needle drop point, which serves as a start point or an end point of an embroidery stitch, is a turning point by determining whether an angle of the needle drop point is smaller than a predetermined quantity, where the angle is defined by a preceding stitch of which the needle drop point serves as an end point and a succeeding stitch of which the needle drop point serves as a start point;

reference point determination instructions for determining at least one reference point from a needle drop point that is judged to be the turning point;

area determination instructions for determining a predetermined area around the needle drop point that is determined to be the reference point, where the predetermined area is based on at least one of thread density of the embroidery sewing, thread thickness, and a pitch length of a stitch;

area internal turning point judgment instructions for judging whether the turning point is in the predetermined area;

adjustment process selection instructions for selecting, in a case where it is judged that the turning point is in the predetermined area, any one of the following adjustment processes: a process for maintaining a coordinate of the turning point, a process for changing a coordinate of the turning point, and a process for deleting the turning point, wherein the adjustment process is selected based on a coordinate positional relationship between the turning point and another needle drop point; and adjustment control instructions for calculating a new coordinate of the turning point that the process for changing the coordinate is selected, where the new coordinate is calculated based on a coordinate of the turning point that the process for changing the coordinate is selected and coordinates of at least two needle drop points adjacent to the turning point that the process for changing the coordinate is selected, and deleting the turning point that the process for deleting is selected.

10. The computer readable recording medium including an embroidery data creation program as claimed in claim 9, wherein the adjustment process selection instructions comprise:

negative change selection control instructions for selecting a process for maintaining a coordinate relative to the turning point at which the selection will be made, based on a positional relationship between the turning point at which the selection will be made and another needle drop point;

change deletion selection control instructions for selecting a process for changing a coordinate of the turning point or a process for deleting the turning point, based on a positional relationship between the turning point at which the selection will be made and a needle drop point adjacent to the turning point at which the selection will be made, in a case where a process for maintaining a coordinate is not selected during execution of the negative change selection control instructions for the turning point at which the selection will be made.

11. The computer readable recording medium including an embroidery data creation program as claimed in claim 10, wherein the adjustment process selection instructions comprise:

first reference distance calculation instructions for calculating a first reference distance based on at least one of thread density of the embroidery sewing, thread thickness, and a pitch length of a stitch; and second reference distance calculation instructions for calculating a second reference distance based on at least one of thread density of the embroidery sewing, thread thickness, and a pitch length of a stitch;

the negative change selection control instructions select a process for maintaining a coordinate relative to the turning point at which the selection will be made in the case where there is no needle drop point having a distance from the turning point at which the selection will be made that is shorter than the first reference distance, from among the needle drop points; and the change deletion selection control instructions select a process for changing a coordinate of the turning point in a case where a distance between the turning point at which the selection will be made and a needle drop point adjacent to said turning point at which the selection will be made is equal to or greater than the second reference distance, and select a process for deleting the turning point in the case where the distance is not equal to or greater than the second reference distance.

12. The computer readable recording medium including an embroidery data creation program as claimed in claim 9, further comprising:

adjustment number counting instructions for counting the number of turning points that the process for changing the turning point or the process for deleting the turning point is selected, from among area internal turning points which are defined as the turning points judged to be in the predetermined area during execution of the area internal turning point judgment instructions; and repetition adjustment control instructions for repeatedly executing the adjustment process selection instructions and the adjustment control instructions relative to all of the area internal turning points until the number counted during execution of the adjustment number counting instructions becomes smaller than a predetermined number.

13. The computer readable recording medium including an embroidery data creation program as claimed in claim 12, wherein the repetition adjustment control instructions execute the adjustment process selection instructions and the adjustment control instructions relative to the area internal turning points in a sequential order that is based on a predetermined order;

and the negative change selection control instructions classify the needle drop points into groups in which the predetermined order precedes or succeeds the turning point at which the selection will be made, and then, makes comparison between a distance to the turning point at which the selection will be made and the first reference distance only with respect to a needle drop point that belongs to the group including the turning point on which the adjustment process selection instructions and the adjustment control instructions are executed.

14. The computer readable recording medium including an embroidery data creation program as claimed in claim 12, wherein the repetition adjustment control instructions classify the needle drop points into at least two groups, and then, repeatedly executes the adjustment process selection instructions and the adjustment control instructions by each group with respect to the area internal turning points that belong to the groups.

15. The computer readable recording medium including an embroidery data creation program as claimed in claim 9, wherein, when a new coordinate is calculated for a turning point that the process for changing the coordinate is selected, the adjustment control instructions treat, as a new coordinate of the turning point, a coordinate of an internally dividing point that serves as a point on a middle line serving as a line segment connecting the turning point that the process for changing the coordinate is selected and a middle point of a straight line connecting two needle drop points adjacent to the turning point that the process for changing the coordinate is selected with each other.

16. The computer readable recording medium including an embroidery data creation program as claimed in claim 15, wherein a divisional ratio of internally divisional points relative to the middle line is provided in plurality, and the adjustment control instructions select divisional ratios sequentially on a one by one basis from the plurality of divisional ratios every time a new coordinate of the turning point that the process for changing the coordinate is selected is calculated, and then determines a coordinate of the internally dividing point.

* * * * *